US006009642A

United States Patent [19]

Nugent

[11] Patent Number: 6,009,642

[45] Date of Patent: Jan. 4, 2000

[54] HOMEOWNER'S METHOD OF SNOW REMOVAL WITH A MOTOR VEHICLE

[76] Inventor: Gordon W. Nugent, 160 Rivergate Dr., Wilton, Conn. 06897-3611

[21] Appl. No.: 09/183,041

[22] Filed: Oct. 30, 1998

[51] Int. Cl.[7] ..... E01H 5/04

[52] U.S. Cl. ..... 37/231; 57/197; 57/241; 57/263; 57/903

[58] Field of Search ..... 37/197, 231, 241, 37/263, 268, 269, 903, 273

[56] References Cited

U.S. PATENT DOCUMENTS

| | | | |
|---|---|---|---|
| 1,199,075 | 9/1916 | Hyde | 293/58 |
| 1,262,966 | 4/1918 | Mahon | 37/263 |
| 1,492,120 | 4/1924 | Calabrese | 37/231 |
| 1,586,786 | 6/1926 | Davies | 37/263 X |
| 1,698,809 | 1/1929 | Angell | 37/279 |
| 1,749,465 | 3/1930 | Caskin | 37/232 |
| 2,601,380 | 6/1952 | Flory | 37/263 X |
| 2,722,064 | 11/1955 | Jaffe et al. | 37/263 X |
| 2,777,218 | 1/1957 | Kiecker et al. | 37/296 X |
| 2,955,367 | 10/1960 | Vort | 37/263 |
| 2,955,368 | 10/1960 | Winsett | 37/231 |
| 3,201,878 | 8/1965 | Markwardt | 37/231 |
| 3,349,507 | 10/1967 | Payne | 37/231 |
| 3,608,216 | 9/1971 | Prescott | 37/231 |
| 3,800,448 | 4/1974 | Preston | 37/43 A |
| 4,074,448 | 2/1978 | Niemela | 37/234 |
| 4,187,624 | 2/1980 | Blau | 37/231 |
| 4,549,365 | 10/1985 | Johnson | 37/251 |
| 4,665,636 | 5/1987 | Borras | 34/234 |
| 4,680,880 | 7/1987 | Boneta | 37/236 |
| 4,962,598 | 10/1990 | Woolhiser | 37/231 |
| 5,046,271 | 9/1991 | Daniels | 37/231 |
| 5,114,120 | 5/1992 | Bartelt et al. | 37/231 X |
| 5,123,186 | 6/1992 | Matushita | 37/251 |
| 5,207,010 | 5/1993 | Grossman | 37/231 |
| 5,209,003 | 5/1993 | Maxfield | 37/252 |
| 5,398,431 | 3/1995 | Beihoffer | 37/249 |
| 5,479,730 | 1/1996 | Gogan | 37/231 |
| 5,513,453 | 5/1996 | Norton | 37/244 |
| 5,666,747 | 9/1997 | MacQueen | 37/273 |

FOREIGN PATENT DOCUMENTS

| | | |
|---|---|---|
| 3331460 A1 | 3/1985 | Germany . |
| 259996 | 12/1928 | Italy . |
| 6306827 | 11/1994 | Japan . |

OTHER PUBLICATIONS

Back–It–Off Driveway Snowplows, Hartley, Texas 3–page ad from Internet Aug. 1, 1998.

Driv'nPlow (Reg TM) car plow, Solotec Corp., Pittsburgh, Pa. 2–page order form Copyright 1997.

Snazzy (TM) snow plow, Burkard Industries, Hillsboro, Ohio 12–page advertising package, Jul. 1998.

Consumer Reports Magazine, Oct., 1997 issue, pp. 28–32: "Alternatives to the snow shovel", (snow throwers test).

Consumer Reports Magazine, Nov., 1998 issue, p. 10: "Don't ditch the snow thrower", (product test).

*Primary Examiner*—H. Shackelford

[57] ABSTRACT

This method provides various high-power-ratio snow removal devices which clear paths narrower than the motor vehicles. We use small, light, low-priced, yet also safe, durable devices to clear the narrow swaths. High power ratios result from applying motor vehicle horsepower to small snow removal devices similar to those found on lawn tractors. Such devices may comprise moldboard plows (FIGS. 3, 9, 10, 11, 15, 16), snow throwers (FIGS. 7 and 13), or combinations of both types (FIG. 12 and 17). Quick-connect and quick-release fittings (FIGS. 3A, 3B, 6, 8, 9A, 9B, 14) position each device for temporary propulsion by a vehicle. The connectors allow quick conversion of the family car to a plowing machine, and when plowing is done, quick re-conversion. A moldboard plow of about half the car's width (FIG. 3) is our preferred embodiment. The mini-moldboard (FIG. 10) is least expensive. Deepest snow can be handled by our tall, narrow moldboard (FIG. 15). We protect homeowners, their cars and their plows from injury when plows strike hidden objects. Protection devices comprise safety springs (60) and pivots (63, 67 and 69) of FIG. 3B, the tension-release mechanism mentioned but not detailed in FIG. 15, annor shields (396, 398) of FIG. 16 and various others mentioned or provided for in our drawings but not detailed. We prefer cars' chassis tie-down ears (72) in FIG. 3A, as connector points for our plow or thrower arms. For cars lacking such ears, we propose add-on ears. For example, tie-down ear (126) in FIG. 6.

19 Claims, 21 Drawing Sheets

HOMEOWNER'S METHOD OF SNOW REMOVAL WITH A MOTOR VEHICLE

BACKGROUND

1. Field of Invention

This invention relates to snow removal methods, specifically to those employing snow plows and snow throwers propelled by motor vehicles.

2. Description of Prior Art

Homeowners have rejected automobile snow plows throughout the automobile's first century. Dozens of different designs, from 1916 to 1997, each advanced the state of the art far enough to earn a United States patent. Several foreign countries also have issued patents for automobile snow plows. But every design sprang from the same fatal misconception. This was the notion that all must conform to the commercial plowing method. Like municipal, highway, mountain-pass, and airport-runway snow plows, virtually every design for homeowners required all motor vehicle wheels to run always on clean-plowed surfaces.

Fixation on that plowing method constricted automobile snow plow design for homeowners to two groups:

First: oversize, overweight, overpriced, overdesigned imitations of commercial street and highway plows for trucks.

Second: undersize, underweight, short-lived cheap imitations of the heavyweight truck plow imitations.

POSSIBLE CAUSES OF FAILURE

Before reviewing problems of failed design in both groups, consider possible underlying reasons for such a calcification of failures accumulating across the century.

The rare, fleeting quality of need for the product surely is an important factor. In most parts of the world where snow accumulates, the homeowner's need for plowing ranges from near zero to merely a few hours per year. Only in winter, only on storm days, only during or after storms of a certain accumulated snow depth and density, and even on those rare occasions, driveway plowing is only required if you really need to drive out soon into a plowed street.

A further explanation for past failure lies in our attitudes toward the automobile. U.S. consumers learn from childhood to think of cars as status badge, rocket ship, music room, anything but work tool. Owners felt little demand for a plow to mount on the family car, because they instinctively recoiled from heavy hardware suggesting body damage.

Thus homeowners missed the fact that among the household's many motors and several engines, the car's is far the most powerful, with the widest range of operating levels. That engine provides ideal propulsion for a properly small car plow. During the slow, stubborn drudgery of driveway plowing, that engine is mostly loafing at low power.

Another cause of failed car plow development is the unglamorous nature of snowplow hardware and its task. Probably some of our best design and engineering talents have been shunted away, to create computers, space craft, and cars resembling jet airplanes.

Yet the need for better home snow-removal methods remains unmistakable. Homeowners die of snow-shovel strokes year after year. They suffer injuries wrestling unwieldy snow-throwing machines while exposed to severe weather. Some even mount plow blades on their summer lawn tractors and bravely attempt a grown-up's job with a child's tools. Consumers would gladly seize a proper automobile plow, if it would clear a frigid midnight storm's accumulation while they drove their own car cars in comfort. They would, if only the car plow were easy to mount and dismount, durable, inexpensive, and easy to store compactly in the home garage.

OVERWEIGHT PRIOR ART

Some examples of prior art in the overweight group: U.S. Pat. No. 1,698,809 to Angell (1929) shows a riveted steel structure elaborately braced with angle irons. U.S. Pat. No. 4,680,880 to Boneta (1987) burdens the moldboard frame with a pneumatic positioning cylinder, compressor, compressor motor and air storage tank. To compensate, he then substitutes aluminum for a steel moldboard, reducing durability.

In U.S. Pat. No. 3,201,878 to Markwardt (1965) and in several other heavyweights we see the same three hydraulic rams as those common in truck plows for instant changes of blade angle and elevation. Homeowners do not need instant blade repositioning.

U.S. Pat. No. 4,074,448 to Niemela (1978) copies more weight-increasing and cost-increasing features from truck plow design. For example: duplicate headlights mounted on the plow support frame. These are suited only to plow moldboards larger than homeowners need. Niemela adds further excessive weight by hinging his moldboard in the center and using hydraulic cylinders to position the two sections in variable vee configurations. His mounting frame severely reduces road clearance. In U.S. Pat. No. 4,187,624, Blau (1980) burdens and complicates plow installation by concealing his hydraulic pump inside the car's engine compartment to discourage theft. Woolhiser in U.S. Pat. No. 4,962,598 (1990) adjusts his moldboard with rack and pinion devices mounted inside frame side rails and a cross beam, all driven by an electric motor protected by a slip clutch. His heavily-framed assembly appears inadequately protected from impact damage by his dubious torsion bar.

All those unnecessary movers require costly materials and excessive manufacturing operations, contribute to overweight and overpricing, and make the plows more difficult to install, operate, maintain and store.

U.S. Pat. No. 3,608,216 to Prescott (1971) relieves you of carrying a heavy plow to your car for mounting. For him you drive your car onto the plow, carefully guiding your front wheels into two narrow metal ski troughs, each attached to a plow arm. Then you complete the mounting job by affixing a web of chains around each wheel, locking them into the troughs.

U.S. Pat. No. 5,666,747 to MacQueen (1997) begins like many others, promising light weight, convenient handling, quick mounting, easy dismounting, and compact storage among the objects of his invention. Then he declares the weight of his plow as 82 kilograms plus mounting fixtures. He proposes to hoist the plow into its car mounts with a block and tackle dangling from a mounting tower above the car's bumper.

UNDERWEIGHT PRIOR ART

The second class of designs developed during this century: undersize, underweight, and short-lived. U.S. Pat. No. 3,349,507 to Payne (1967) achieves light weight partly by omitting the necessary trip mechanism to protect the moldboard from ruin when it strikes such obstructions as hidden ice blocks and curbs. His bumper-clamp-mounted moldboard plow represents a group of patents doubly doomed. First by their sheep-like following of the usual full-vehicle-width plowing method, unsuited to home driveways. Second, by fashionable absorption of automobile bumpers beneath cosmetic body bulges.

Cardboard is the construction material for the plow of U.S. Pat. No. 5,207,010 to Grossman (1993). His box-shaped plow skids along the ground, pushed by the vehicle bumper. In one embodiment the vehicle reverses course but the plow does not because the two are unconnected.

The ultimate lightweights were achieved in a group of patents such as Hyde's U.S. Pat. No. 1,199,075 (1916). They were for nominal snow plows, but their narrow blades do not clear driveways or home parking areas. Instead they plow grooves ahead of the car's wheels. Such designs may permit escape from some snowbound conditions and get the family car out into the world. But the later return home is likely to be blocked by a rutted driveway hardened into an impassable ice block by weather changes.

Clinging to the notion that it is easier to dig two ruts than to plow a driveway clean with a single snow removal means, the following inventors each found new variations on their theme. Davies, in U.S. Pat. No. 1,586,786 (1926) suspends a pair of flat plows, poor shapes for his purpose, with pointless curved perimeters, from awkward three-leg tripods, entirely unprotected against impact. Mahon, in U.S. Pat. No. 1,262,966 (1918), equally unprotected, presents a more complex setup, much more difficult to mount and dismount, partly because of his locking blade-height adjuster operated from the driver's seat. U.S. Pat. No. 2,955,367 to Vort (1960) suspends both tire-path plows from a single clamp on the center of the car's bumper. His clamp appears likely to disengage from plow impact shocks. Vort teaches away from the idea of clearing a drive or home parking area, by repeated references to his devices as "shovels" and "scoops". Jaffe in U.S. Pat. No. 2,722,064 (1955) defines this group's narrow goal: ". . . to clear a track amply wide for the passage of the wheels . . . only so much snow is removed as is required to allow clear passageway."

Winsett, in U.S. Pat. No. 2,955,368 (1960) here represents a small group of U.S. patent achievers who motorized such rut-diggers. He uses two drive belts from the car's engine to operate a pair of windshield-wiper-like oscillating sweepers before the front wheels.

Every motor vehicle snowplow of commercial significance since the automobile's invention has used the plowing method shown in FIG. 1. Diagonal lines designate a plowed-clear area 40, bounded by a virgin snow field. Vehicle wheel tracks 43L and 43R always follow in the cleared area, well behind the forward edge of the snow removal device which stopped at line 44.

Rut diggers, of no commercial significance, provided the only alternative snow plowing method of the Twentieth Century. FIG. 2 shows their marginal method, of academic interest only. Diagonals again identify the plowed-clear areas, here 46L and 46R. Each is cleared by separate snow removal devices, which stopped plowing at lines 49L and 49R.

EXCEPTIONS TO THE RULE

We have found but three stragglers from the hundred-years lockstep march of this art under the one-and-only-method banner: Every Wheel Always Must Run Behind a Plow.

In U.S. Pat. No. 1,492,120 to Calabrese (1924), he angles his full-vehicle-width moldboard behind one front wheel and ahead of the other, producing a unique three-wheels-plowed posture. Borras, in U.S. Pat. No. 4,665,636 (1987), and Caskin, in U.S. Pat. No. 1,749,465 (1930) both place a rut-digger ahead of each rear wheel.

Neither Calabrese nor Borras nor Caskin nor I can describe any advantage whatsoever created by their odd deviations from the rest of Twentieth Century art.

PRIOR ART IN SNOW THROWERS

Turning now to the other main body of pertinent art, snow throwers, we see some parallels. First, this is also a crowded art, developed over a century, with many United States patents. Second, we see a clear demarcation between heavyweight and lightweight machines. Third, every snow thrower design for a motor vehicle has used the same plowing method that has stifled development of moldboard plows for cars: each plowing pass clears a path for all four vehicle wheels. But here the parallels end.

Lightweight snow throwers, unlike lightweight moldboard plows, have not been designed for homeowner automobiles or sport-utility vehicles. Even for pickup trucks, few designs have been made. Lightweight snow throwers have been developed only for garden tractors, self-propelled machines, operator-pushed, or, lightest of all, operator-carried devices. Nobody has tried to make a snow thrower for a passenger car.

In U.S. Pat. No. 4,549,365 to Johnson (1985) he proposes a thrower for light automotive vehicles such as pickup trucks. But his drawings define the heavyweight, with an auger diameter nearly equal to that of his truck tires. U.S. Pat. No. 5,479,730 to Gogan (1996) presents another heavyweight thrower for pickup trucks. His drawings show the auger-and-fan engine as nearly the same size as the truck engine. A wide airport moldboard is defined in U.S. Pat. No. 5,513,453 to Norton (1996). It has a thrower rotor nestled into a curved wing at each end of the moldboard. His combination of rotor and moldboard is less common in throwers than that of rotor or fan with an auger. Kiecker et al, in U.S. Pat. No. 2,777,218 (1957) take this combination a step further: thrower with two moldboards. A tractor pulls their rig; the tractor's power takeoff drives their thrower's rotor. In U.S. Pat. No. 3,800,448 to Preston (1974) we have a center-hole moldboard with a throwing wheel operating in the hole. This is also intended for tractor mounting, with its wheel driven by belt from the tractor engine.

Prior art in snow throwers for walking operators relates to my plowing method, as does the prior art of heavyweight throwers. Most of these snow throwers incorporate a prime mover, usually an internal combustion engine; an intake scoop with one or more augers to break up the snow and carry it toward one or more throwing paddle wheels; and an adjustable discharge chute. The motorized functions of breakup, feeding, and throwing are weakened by diversion of power in the self-propelled machines. These usually provide a transmission with several forward speeds and two or more reverse speeds, all powered by the same engine, typically one-cylinder, that must also power the breakup, feeding and throwing. The complexity of these machines causes a variety of maintenance and operating problems.

Our plowing method invites implementation by selecting and adapting the best elements of snow throwers, as with moldboards. U.S. Pat. No. 5,209,003 to Maxfield et al (1993) presents two such elements: auger-shaft end cones in the snow pickup box, to prevent ice buildup, and shortened augers, to allow straight flow of a substantial part of the snow through the center of the pickup box, directly into the impeller. U.S. Pat. No. 5,398,431 to Beihoffer et al (1995) provides a single-stage thrower with impeller containing icebreaker teeth. U.S. Pat. No. 5,123,186 to Matshita et al (1992) exemplifies heavyweights in the walking-behind group with its engine-powered crawler treads. Each of these machines would clear much more snow faster if moved forward by automobile power. Then thrower engines can be released from propulsion, to concentrate on throwing snow.

TODAY'S CONSUMER MARKETPLACE

The commercial failure rate for automobile snow removal devices has held near 100 percent for a hundred years. Though the art was crowded, the consumer marketplace has remained continually barren. Search vigorously today, and you find only three attempts to meet the clear need: the wide SNAZZY (TM) folding moldboard plow, made by Burkard Industries of Hillsboro, Ohio; the wide DRIV'N PLOW (Reg. TM) plastic plow, made by Solotec Corporation of Pittsburgh, Pa.; and the BACKitOFF (TM) convertible plow and cargo holder, made by Driveway Snowplows of Hartley, Tex.

To mount the SNAZZY (TM) plow on your car you must first buy a trailer-hitch ball-mount frame. You probably then must hire a specialized mechanic for the necessary drilling and/or welding and/or other adaptations, depending on the year and model of your car. He will mount this heavy device permanently on the front of your car, unless you wish to do your plowing backwards. Front or back, the mounting frame will reduce your car's road clearance. With many cars these days, that can be a serious disadvantage. The moldboard is made of galvanized sheet metal, folded origami-style into more than a dozen structures intended to strengthen the thin surfaces. The moldboard mounts to the ball hitch with a three-arm frame. The whole assembly tends to rotate around the ball during plowing. To prevent that, stabilizing chains run from two arm ends to two car frame corners. Lack of an obstacle-trip safety mechanism, coupled with the choice of moldboard construction material, appear to guarantee a short life for this product.

The DRIV'N PLOW (RTM) plow, made mostly of plastic, also appears too flimsy to last long. Its plowing width of nearly two meters almost matches that of the only other plastic plow we found (for trucks), the WESTERN (RTM) Poly Plow, made by Douglas Dynamics, Milwaukee, Wis. But the latter is 14 times heavier, therefore stronger. Yet the heavy plow has an impact protection trip mechanism; the light plow has none. Consumer Reports Magazine rejects this plow as likely to damage your car. The editors, in their November 1998 issue, page 10, are evidently unaware of the other two consumer plows discussed here.

The BACKitOFF (TM) plow is advertised as a combination of backward-pushing snow plow and cargo carry-all. It mounts only on a rear trailer hitch. The moldboard is flexible, shown in one photo as wrapped around a deer's carcass and in another around a load of firewood. The design does not seem to promise durable snow-plowing service.

REMAINING CONSUMER ALTERNATIVES

To clear your driveway without shoveling, you have only four other alternatives. All have serious drawbacks. In order of increasing cost, the choices are:

First, buy a moldboard-type plow or snow thrower for the garden tractor you already have. If you must buy the tractor, of course, this option becomes very costly. Tractor plowing reduces your risk of stroke, but imposes much noise and vibration. Owners report their garden tractors lack power to plow or pile deep snow.

Second, buy a non-tractor snow-thrower. These are typically powered by a one-cylinder gas engine like the garden tractor. Throwers demand strong men to maneuver their weight while withstanding considerable vibration, noise and winter winds. They cost $848 on average, says Consumer Reports Magazine, October, 1997 issue, pp. 28–32. Throwers are awkward to store and costly to maintain.

Third, hire a whizzer. This is a local fellow whose only qualifications for billing at $400 to $500 per hour for days after a storm are A) access to a pickup truck with plow, and B) an unwavering concentration on the clock as he whizzes up your driveway, makes a few sudden lunges at your landscaping, then whizzes next door. I have clocked our local whizzer at four minutes per home along our street. SNOWMAN (TM) Snowplow, of Bloomfield, Iowa, currently addresses this message to whizzers: "Our snowplow can increase your snow removal by at least five driveways per hour . . . " If your driveway is gravel, expect to clean rows of whizzer-deposited gravel from your lawn every spring. Another problem with whizzers is their thin record for reliability. Even if their often costly service is adequate in average conditions, it may fail when you need it most.

Fourth, buy a truck or truck-like compromise vehicle and a truck plow.

OBJECTS AND ADVANTAGES

Accordingly, several objects and advantages of my invention are:

a) to provide a new method of plowing snow with a motor vehicle, releasing plow designers from the 4-wheels-cleared bottleneck they have abided for a hundred years;

b) to provide snow-removal devices of newly modest proportions to support the new plowing method;

c) to create high-powered devices, able to overcome snow, ice, and ground-friction more easily than truck plows can;

d) to improve homeowners' quality of life by getting rid of their driveway snow at lower cost and with greater reliability than present methods;

e) to select and retain essential, time-tested features of truck highway snow plows, garden tractor plows, and snowthrowers, while adapting all of them to homeowner driveway scale;

f) to provide quick-attach and quick-detach features, easy for a small, blind woman to operate, releasing the family car, sport-utility vehicle, minivan or other vehicle from plow duty between storms;

g) to fill the vacuum in the marketplace by meeting the consumer's need for practical, low-cost automobile snow removal devices;

h) to provide lightweight, durable snow-removal devices unlikely to need costly repair;

i) to protect home landscaping by replacing careless big-plow whizzers with small tools easily steered by homeowners;

j) to provide motor vehicle snow removal devices compact and convenient to store;

k) to enhance personal safety of homeowners by sparing them unaccustomed, and sometimes life-threatening, strenuous exercise during exposure to severe weather;

l) to provide a manufacturer with devices to support my plowing method, using minimum proportions, common materials, simple fabrication processes suited to existing tooling, minimizing re-tooling, keeping manufacturing costs low;

m) to utilize the presently wasted secondary-use potential of millions of homeowner automobile engines;

n) to preserve vehicle ground clearance by avoiding bulky and heavy mounting brackets;

o) to enhance homeowners' independence by releasing them from effective monopolies held by whizzers in many neighborhoods;

p) to provide low-maintenance or maintenance-free snow removal devices; and q) to enable many persons to earn income by helping to provide the method and the embodiments arising from this patent: manufacturers, retailers, distributors, their employees, their communities, their neighbors, their suppliers, and their customers. Although this object and advantage may be implicit in all patents, we feel its importance warrants occasional enunciation.

Still further objects and advantages will become apparent from a consideration of the ensuing description and drawings.

DRAWING FIGURES

Closely related figures have the same number but different alphabetic suffixes.

REFERENCE NUMERALS IN DRAWINGS

Figure 1:
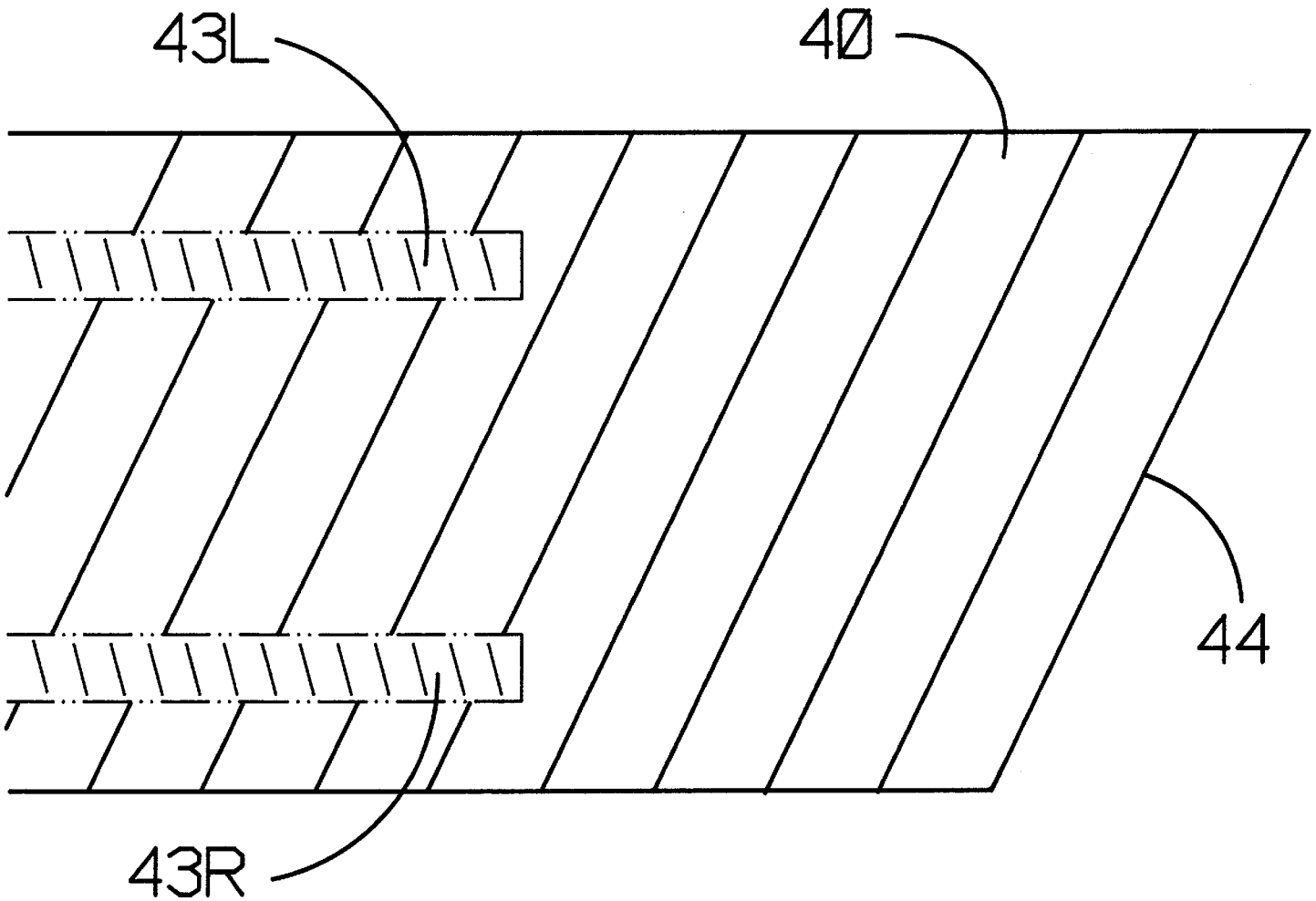
FIG. 1 is a plan view of the imprint in a virgin snow field made by a motor vehicle device using the mainstream plowing method.

| | |
|---|---|
| 24 flange | 30 moldboard |
| 33 telescoping arm | 34 slide |
| 35 right arm assembly | 36 left arm |
| 37 reversible blade | |
| 38R,L right and left projected wheel tracks | |
| 39 blade bolt | 40 plowed area |
| 42 flag | 43L left wheel track |
| 43R right wheel track | 44 forward edge of plowed area |
| 45 flagpole | 46L left plowed rut |
| 46R right plowed rut | 48 flagpole socket |
| 49L left forward plowing edge | 49R right forward plowing edge |
| 50 narrow-swath plowed area | |
| 51 rib | 54 moldboard ear |
| 60 safety spring | 61 rib hole |
| 63 lower rod | 67 upper rod |
| 69 anchor rod | 72 chassis tie-down ear |
| 73 mounting hole | 76 washer |
| 78 chassis rail | 81 bottom rib |
| 84 skid | |
| 85 mounting pin | 86 locking holes |
| 88 pin base | 89 hitch pin |
| 90 car | 91 driveway |
| 92 garage snow pile | 93 adjusting hole |
| 94 public road | 95 snow pile |
| 96 larger snow pile | 97 parking are perimeter |
| 98 smaller snow pile | 99 lesser snow pile |
| 100 hook arm | 102 hook |
| 104 hook snap latch | 106 handle |
| 108 main slot | 110 locking slot |
| 112 operating shaft | 114 spring compressor |
| 116 guide block | 118 latch spring |
| 120 latch pivot hole | 121 frame rail end |
| 122 latch hinge | 123 frame rail hole |
| 124 swivel | 125 frame rail slot |
| 126 add-on tie-down | 128 mounting plate |
| 130 anchor post | 132 lower mount hole |
| 134 upper mount hole | 136 plow mount hole |
| 139 auger assembly | 140R right half auger |
| 140L left half auger | 142 auger housing |
| 144 discharge chute | 145 impeller intake |
| 146 thrower engine | 147 garage |
| 148R,L right and left thrower wheels | |
| 160 drawbar | 162R,L mounting wings |
| 164R,L right and left hitch sockets | |
| 166R,L right and left ball assemblies | |
| 168R,L right and left mounting arms | |
| 170R,L right and left hitch balls | |
| 171 electric winch assembly | 172 winch mounting plate |
| 173 winch mounting holes | 174 drawbar holes |
| 175 motor | 176 winch drum |
| 177 winch chain | 180 ladder frame assembly |
| 182 crossbeam | 183 bracket |
| 184 center frame hole | 185R,L lateral chains |
| 188R,L right and left ladder frame arms | |
| 190 ladder brace | |
| 192R,L right and left ladder arm holes | |
| 194R,L right and left bracket holes | |
| 196 hinge pivot | 197 bracket locking hole |
| 198 bracket hole | 210 pitch adjusting holes |
| 212 pitch adjusting rod | 214 bottom locking rod |
| 216 radial adjuster | 218 kingpin |
| 220U,L upper and lower merge plates | |
| 222 ring crossbeam | 223 angle selectors |
| 224 pin spring | 226 selector pin |
| 228 lower hinge | |
| 233L,R left and right light mounting arms | |
| 280 mini-moldboard | 310 left moldboard |
| 312 right moldboard | 314 right mounting shaft |
| 316 left mounting shaft | 330 ice-breaker tooth |
| 332 pin breaker | 334 complex moldboard |
| 336 moldboard left collector | 338 moldboard upper curl |

-continued

| | |
|---|---|
| 340 rotor assembly | 342 engine |
| 344 impeller shaft | 346 shaft hole |
| 348 impeller blades | 360 impeller housing |
| 370 deep-snow moldboard | 371R,L right and left sidewalls |
| 372R,L right and left braces | 374R,L right and left upper arms |
| 375R,L right and left lower arms | |
| 380 parallel stacks | 382 impeller intakes |
| 384 pickup blade | 386 snow guides |
| 388 prime mover | 390 vee-block plow |
| 392 web belt | 394 belt anchor |
| 396 side armor shields | 398 front armor shields |
| 420 overflow moldboard | 422 snow intake box |
| 424 off-angle auger | |

SUMMARY

A narrow-path, high-power-ratio, snow plowing method for clearing home driveways. This method provides and uses scaled-down but durable plows, temporarily positioned for propulsion by the family car.

DESCRIPTION OF PREFERRED EMBODIMENT

Figure 3:
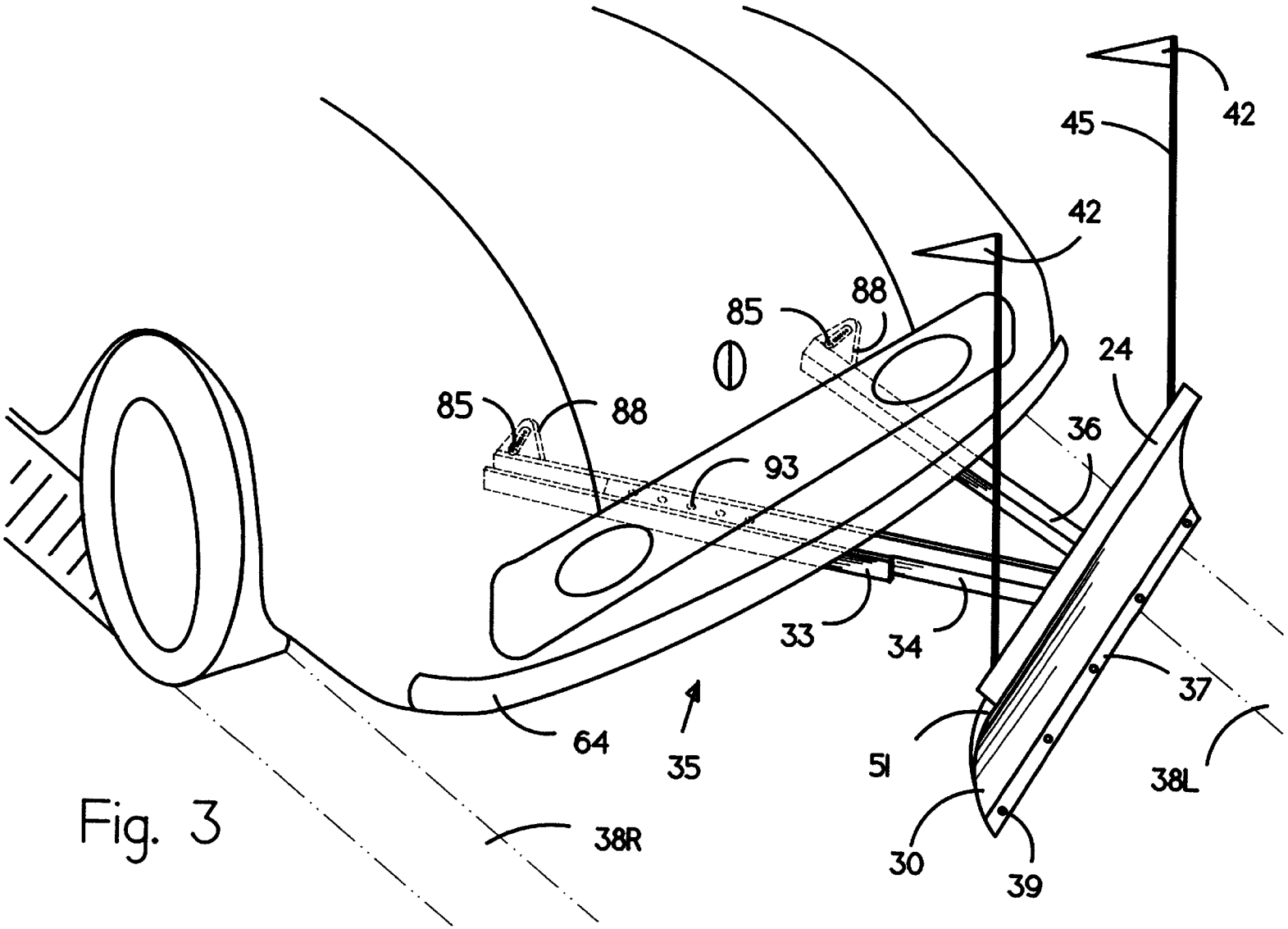
FIG. 3 shows an overall perspective view of the preferred embodiment of my snow removal method.

The preferred embodiment of my plowing method is shown in perspective view in FIG. 3. The left edge of a moldboard, plow or bulldozer blade 30 and of a reversible blade or cutting edge 37 are positioned just outboard of a projected left wheel track 38L. A plurality of blade bolts, screws or clamps 39 fasten blade 37 to moldboard 30. A pair of guide flags, pennants or markers 42 is attached atop a pair of removable flagpoles 45. A plurality of ribs, braces or flanges 51 is spaced across the back of moldboard 30 and may be seen more clearly in FIG. 3B. A flange, cross-rib, or stiffener 24 forms the upper edge of moldboard 30.

All parts preferably should be made of steel for strength, durability and economy. However, the flagpoles and their flags need less strength and more flexibility. Fiber-reinforced plastics are suitable for these parts.

A pair of arms attaches moldboard 30 to the car's front chassis. A telescoping mounting arm, strut or right connecting beam 33, together with an inner extension or adjusting slide 34, make tip a telescoping right arm assembly 35. A fixed-length left arm or strut 36 is somewhat shorter than most extension positions of arm assembly 35. Both telescoping arm 33 and its slide 34 have a plurality of matching holes 93, for bolting the two arm parts together after adjusting arm length. Each arm ends in a mounting flange or pin base 88 and a mounting pin or bolt 85, both seen more clearly in FIG. 3A.

Figure 3A:
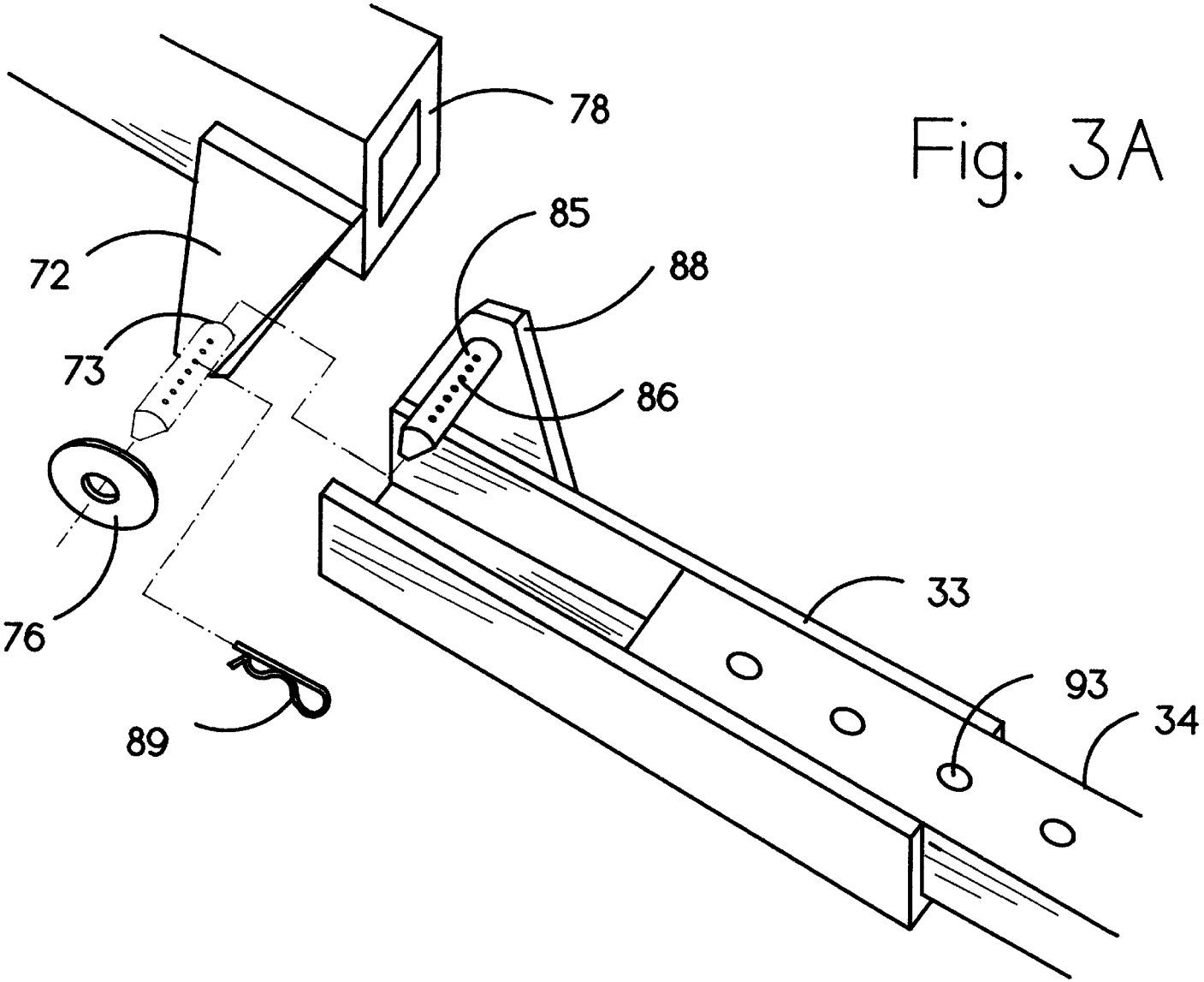
FIG. 3A is an exploded closeup view of the right arm quick-connecting mechanism for arm attachment under the car in the preferred embodiment.

FIG. 3A shows in perspective view telescoping arm 33 and its quick-connecting mechanism for attachment beneath the car's front end. Base 88 is fixed at the end of telescoping arm 33. Quick-connecting pin 85 is fixed to base 88. Pin 85 has a plurality of through holes or locking holes 86 to accommodate a hitch pin or spring clip 89. A washer or spacer disk 76 is sized to fit over quick-connecting pin 85. A chassis tie-down ear or anchor point 72 is fixed to a chassis rail or box frame member 78. A mounting hole or ear hole 73 is located in chasis tie-down ear 72, to receive quick-connecting pin 85.

Figure 3B:
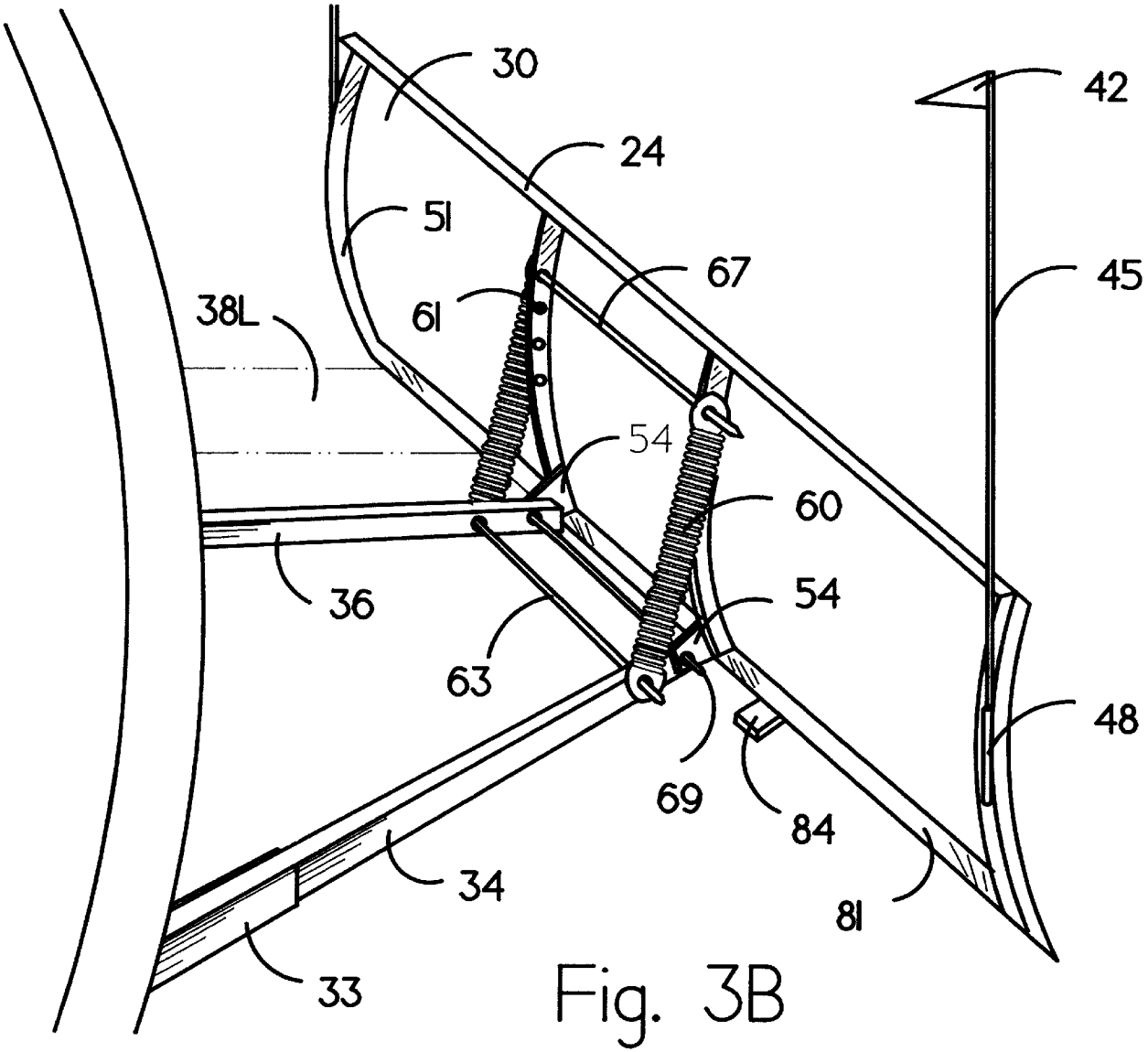
FIG. 3B shows in perspective a rear view of the preferred moldboard's mechanisms.

FIG. 3B shows a perspective view of the mounting mechanism behind moldboard 30 of our preferred embodiment. The upper ends of a pair of safety springs 60 are hinged to moldboard ribs 51 by insertion of an upper hinge or anchoring rod 67 through a matching pair of rib holes or adjusting holes 61. A plurality of additional holes 61 allows moldboard 30 to be adjusted from vertical to forward tilt to backward tilt. The rod passes through both spring ends and their adjacent moldboard ribs. Lower spring ends are hinged to left and right arms by a lower hinge or anchoring rod 63. This rod passes through both spring ends and both arms. Both arms are hinged to moldboard 30 at a pair of moldboard anchor tabs or ears 54 by an anchor rod 69. This rod passes through both ears and through aligned holes in both arm assembly 35 and arm 36. All three rods are secured in their places by a plurality of hitch pins 89 (not shown in this drawing) inserted through transverse holes at rod ends. A pair of flagpole sockets, holders or tubes 48 is attached to ribs 51. Welded to a bottom rib 81 is a pair of skids, feet or blade wear diffusers 84.

OPERATION OF PREFERRED EMBODIMENT: MOUNTING

In three minutes or less, using no tools or skills, a small, blind woman can mount our plow easily on the family car. After her driver clears away the snow, she will release car from plow just as easily. She can stow it in less garage space than the typical child's bike or lawn mower needs.

Parking before the storm, her driver backed the car into her garage. Next morning she puts the gear lever in park, sets the car's emergency brakes, and pockets the ignition key: safety first. Then she sits or kneels beside a front fender, reaches about 30 cm beneath the car, feels for chassis tie-down ear 72, and slides arm quick-connecting pin 85 through mounting hole 73. She slides washer 76 snugly against the ear. She locks pin 85 in place with hitch pin 89 through the nearest locking hole 86 outside the washer. Then she repeats with the other mounting arm.

Next she walks moldboard 30 into position by pivoting it on the corners of a short side, to avoid or reduce lifting. She then lowers the upper end, leaving the moldboard standing on skids 84 and blade 37. She attaches each arm to moldboard 30 at ears 54, using anchor rod 69 and hitch pins 89. She completes the hookup by locking the bottom ends of springs 60 to the arms, using bottom rod 63 and more hitch pins. After she inserts flagpoles 45 in sockets 48, her plow is ready for action.

In summary, she has quick-changed car into plow by easily positioning a few parts, and locking them in place with six hitch pins.

OPERATION OF PREFERRED EMBODIMENT: PLOWING

Figure 4:
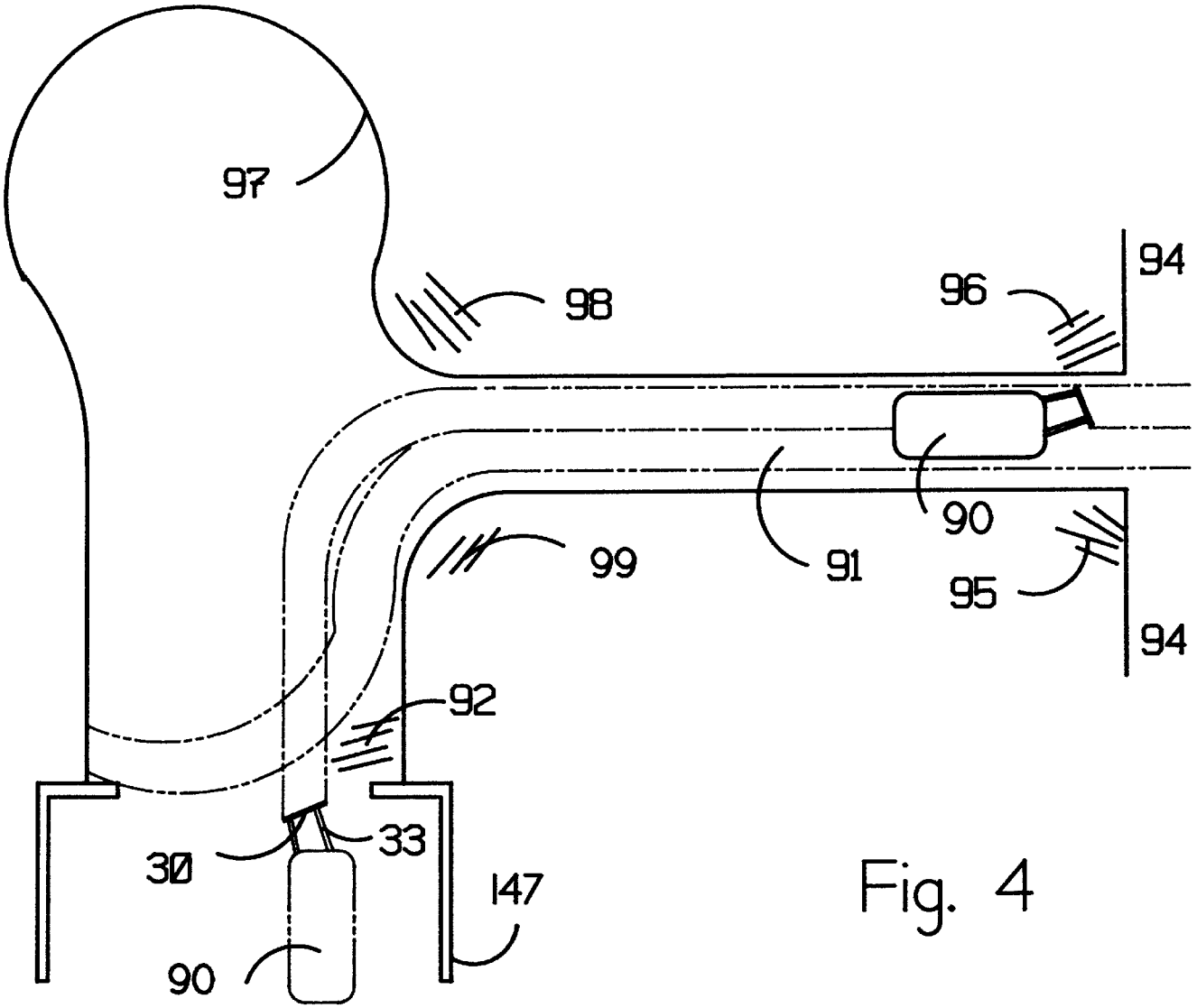
FIG. 4 is a plan view of plowing passes in a homeowner's driveway and parking area.

FIG. 4 shows a car 90 making its first plowing pass down a driveway 91 from a garage 147. Moving eastward, the driver leaves a neat ridge of plowed snow along the north side. The second pass, from a public road 94 back up the driveway, leaves a small snow pile 92 near the garage door. Commercial plowmen hydraulically drop their moldboards behind pile 92 and drag it backward away from the garage door. They call it backplowing. With this embodiment of my plow, the homeowner must back again into the garage while keeping the plow away from pile 92. Then she steers toward pile 92 to push it away. To complete the driveway and parking area out to a perimeter 97, he or she must make a few more plowing passes than the commercial plowman because the homeowner's plow is narrower.

In all other respects, this homeowner's work is easier than the commercial plowman's. There is no quick-money time pressure. The plow need not be lifted and lowered repeatedly with hydraulic controls. The homeowner merely drives and drags.

The main reason to add a lifting device to my preferred embodiment might be to reduce wear on reversible blade 37.

My working model's cutting blade is 5 mm thick. The typical 350-kilogram plow on a truck has only a 9 mm blade. It will thus be a long time before my homeowner's blade is worn enough to require unbolting and reversing to use the new, opposite-side edge. For a small cost increase we could match truck plow thickness. But that is unnecessary.

Snow pressure against my moldboard's face and its blade 37 press them down against the driveway surface during plowing passes, as does the weight of the assembly. When blade 37 strikes an obstruction, such as broken pavement, a rock in a gravel driveway, or an ice block hidden in a snow pile, the moldboard pivots forward on anchor rod 69, snapping face down on the driveway, stretching springs 60. The springs then return the moldboard to plowing position. The hinge-and-spring action saves the assembly from severe damage or destruction. That time-tested function has established the spring-loaded hinge in the art as a necessity for most moldboards.

However, in our preferred embodiment, that safety device provides a completely unexpected advantage over state-of-the-art designs. The springs here help in piling snow. Plowing creates snow piles at a pair of corners 98 and 99. A pair of larger piles 95 and 96 are augmented by road plows. When the commercial plowman pushes snow toward such a pile, he raises his moldboard hydraulically to add the fresh-plowed snow atop the pile. Otherwise each pass to the pile would enlarge its base and narrow the clean-plowed area.

When my preferred embodiment approaches the pile, snow pressure on the moldboard face rises abruptly when it reaches the pile. The moldboard then swings forward unexpectedly, tilting forward against its snowload and squeezing it upward. At the same time arms 35 and 36 pivot on pins 85 at chassis tie-downs 72, allowing moldboard 30 to slide up the pile's side and add the new load well above the pile's base. This parallels the snow piling function of hydraulically-equipped plows, without the expense of hydraulics. The driver controls piling height by varying the car's speed.

Omitting mounting plates 88 would cut costs. Pins 85 would then be set directly into the ends of arms 33 and 36. However, plate 88 is better for most cars because it allows more clearance between arm and bumper bottom or other front-end components. That extra clearance in turn allows greater arm lift for piling snow.

Flags 42 on flagpoles 45 help the driver at all times but more especially at night when distances are harder to judge. Large plows block headlights, requiring plowing lights to be added. None are needed here.

Skids 84 help diffuse downward forces, reducing blade wear. Skids improve convenience when mounting and dismounting the plow. Skids let the moldboard stand on its own feet.

Figure 2:
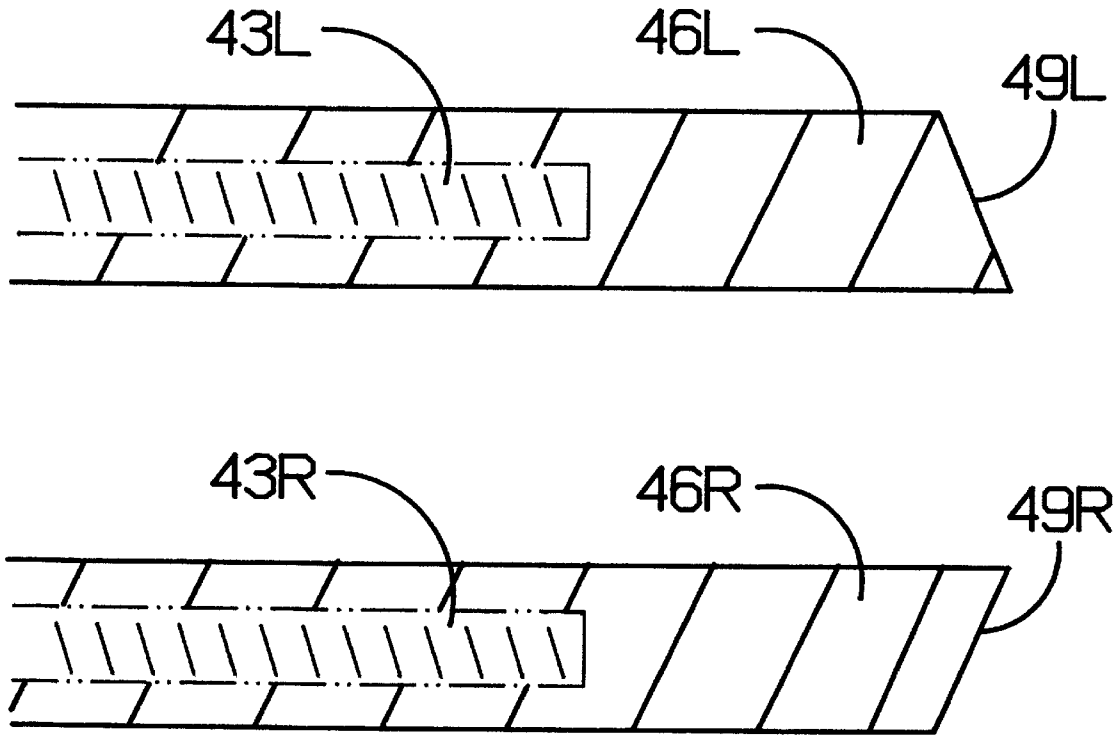
FIG. 2 is a plan view of the imprint in a virgin snow field made by a motor vehicle device using the marginal plowing method.
Figure 5:
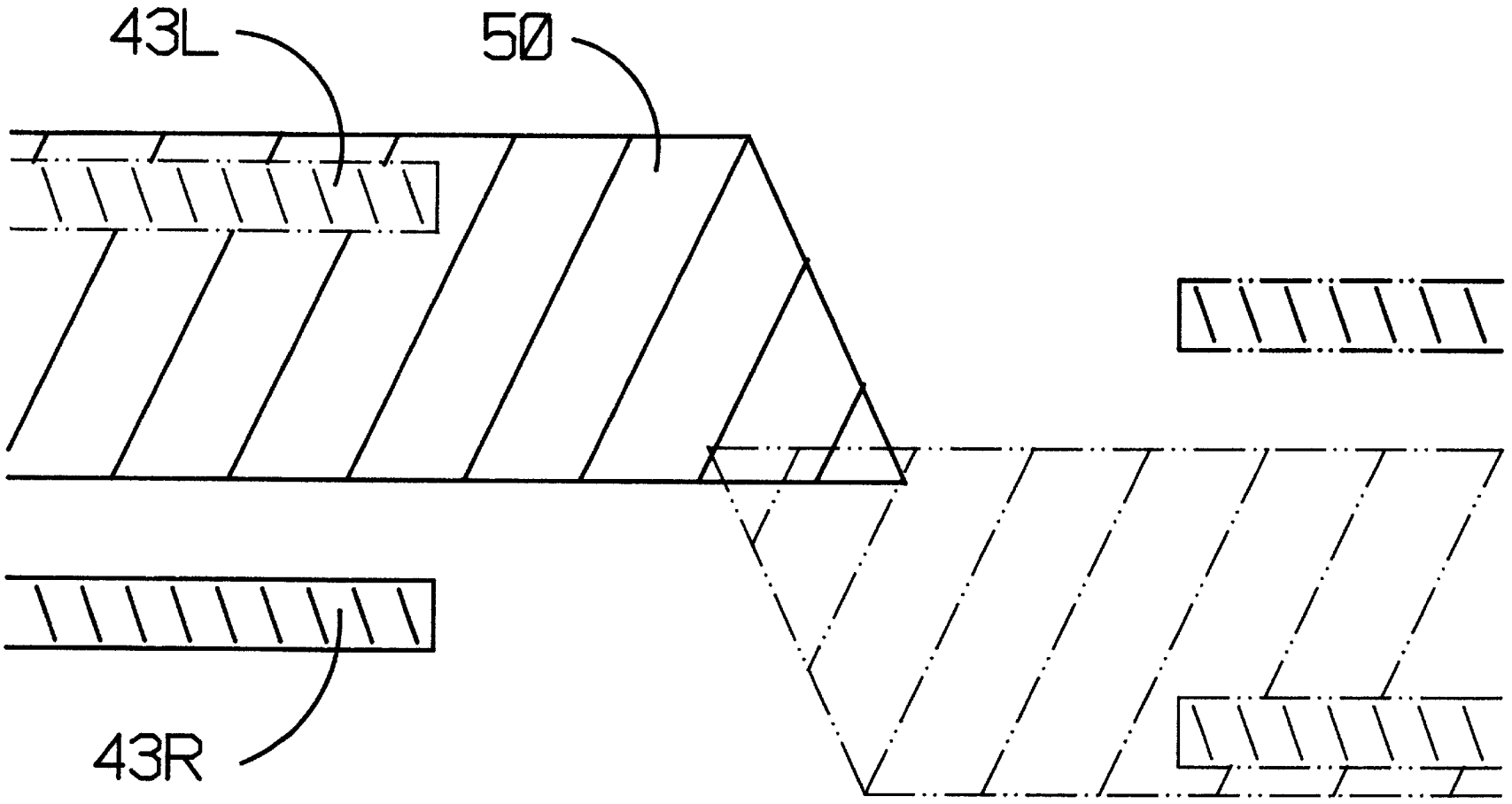
FIG. 5 is a plan view of the imprint in a virgin snow field made by my new narrow-path snow removal method.

FIG. 5 depicts the radical departure of my plowing method from the mainstream history-of-the-art method shown in FIG. 1, and the marginal method of FIG. 2. The diagonal lines in FIG. 5 identify a clean-plowed area 50 created by my preferred-embodiment plow in a virgin snow field. Vehicle wheel track 43L is made on a fresh-plowed surface behind the plow, as in the two century-old methods. However, the narrow-swath snow removal device essential to my method requires wheel track 43R to be imprinted in the virgin snow field on the plow's first pass. On the second plowing pass, shown in the right-side phantom-line drawing, and in all subsequent plowing passes, my method runs all vehicle wheels mostly in plowed paths of least resistance.

THEORY OF OPERATION

The extremely effective performance of my plow, including its unexpected but very useful piling ability, may be explained, I believe, by three factors: massive relative horsepower, massive relative traction, and massive relative inertia of motion or total momentum.

First, my preferred-embodiment moldboard is similar in size, weight and shape to those used on garden tractors with one-cylinder engines. The horsepower now available to push that plow is multiplied at least tenfold, a massive increase. Homeowner motor vehicles delivering such horsepower include passenger cars, pick-up trucks, sport utility vehicles, mini-vans, vans or the like, but not lawn tractors, carts or similar vehicles. Another way to appreciate the surprising power of this small plow: its working face has about the same area as that of two average hand snow shovels.

Second, most motor vehicles today are equipped with high-traction, all-weather radial tires. These put a much larger and more effective footprint on the ground than a garden tractor can, and also take a wider stance. Not only tire and wheel size and tread pattern, but also the vehicle's greater weight, make this footprint a massively more effective launching pad than small tractor tires.

The third massively increased force driving my plow is the rolling momentum of 1½ to 2 tons of automobile.

The three combined forces make this plow irresistible. It moves with ease through a 30-cm depth of encrusted dense snow and ice balls. It happens even on a maximum-resistance first pass, when the eccentric mounting of my preferred embodiment brings the car's opposite-side wheels into unplowed territory.

The simplest way to understand this plow's powerful performance may be to compare it with the average truck plow, which has served so many inventors for so many years as exemplar for their homeowner snowplow designs. Mine is a much higher-powered plow. More specifically, the horsepower per square meter available to my preferred embodiment plow is typically four times that for an average truck pushing a medium-size truck plow. Mine creates this great advantage by cutting a narrow path with a working face about one-fourth the size of the truck plow's.

A specific example: the current Ford 250 (RTM) Heavy Duty Crew Cab 4-wheel-drive truck has a 245-horsepower engine. Pushing a middle-size Western (RTM) plow with a 1.74 sq meters working face, this plowing rig has a power ratio of 141 horsepower per sq meter. My plow, with a working face of 0.41 sq meters, mounted on a popular current car, the Ford Taurus (RTM),with its typical 235 horsepower engine, has a power ratio of 573 horsepower per sq meter, four times the truck's level.

Neither car nor truck often approach maximum horsepower use in plowing, of course. But the point is, at any operating level, say 20 percent of maximtum, my plow remains four times more powerful than the truck plow. The abundant power margin makes it easier for my plow to overcome snow, ice, and ground-friction resistance than for the truck plow meeting the same obstacles.

A high power ratio characterizes all other embodiments of my method described below, not only the preferred embodiment. For example, if the mini-moldboard has half the working face area of the preferred embodiment, then its power ratio is eight times that of the truck plow.

DESCRIPTION AND OPERATION OF ALTERNATE MOUNT

My survey of local parking lots indicates that about half of today's motor vehicles comes factory-equipped to mount my preferred-embodiment plow. Many have frame tie-downs similar to that shown in FIG. 3A as chassis tie-down ear 72. Tie-downs are likely to multiply, due partly to rising popularity of sport-utility vehicles, vans and trucks among homeowners.

Figure 6:
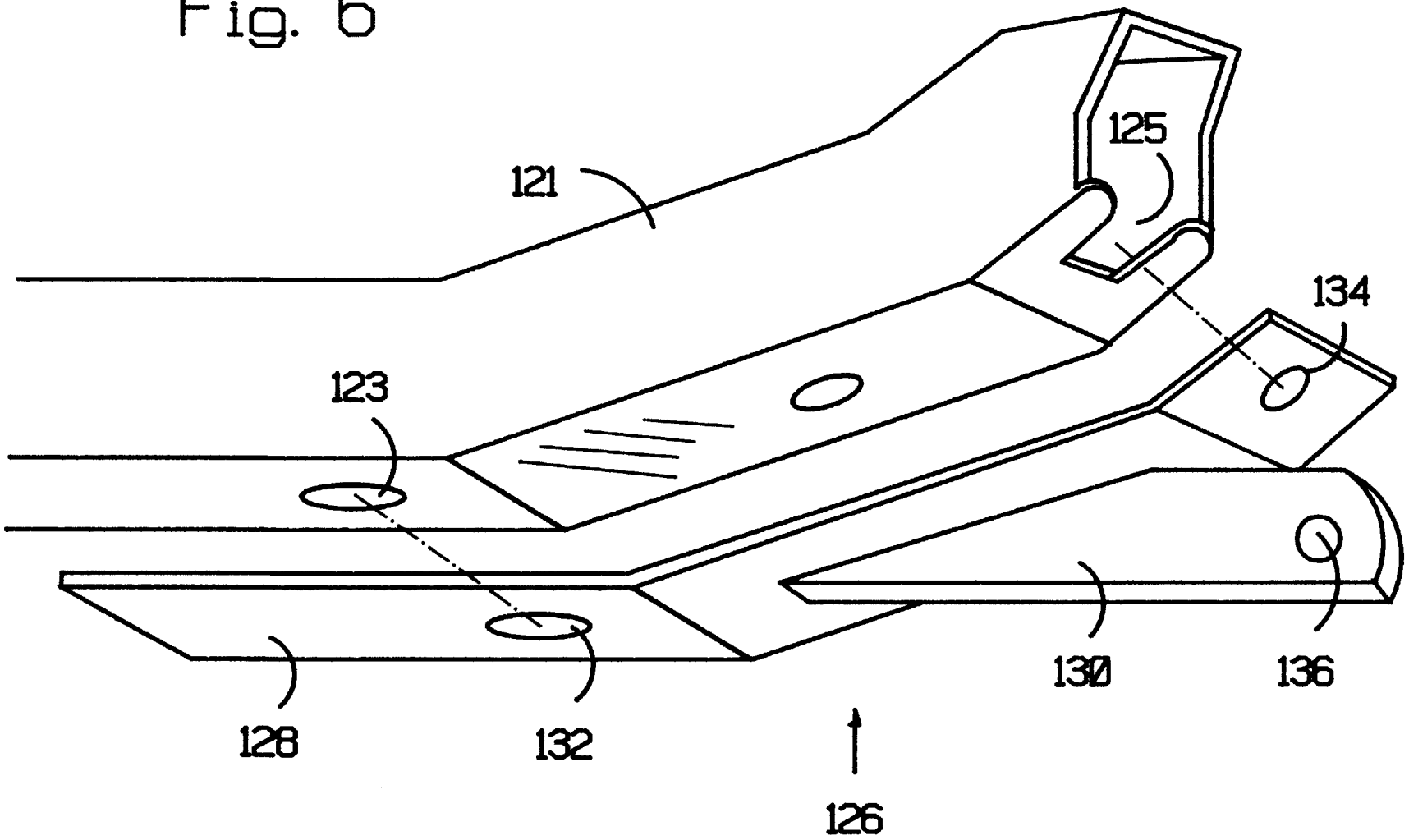
FIG. 6 shows an exploded view of a front frame end on a car requiring add-on ears as anchor points for plow arms, together with a proposed add-on device.

Cars not already so equipped to mount plows will need simple, inexpensive, add-on mounting devices. Most truck plows have mounting fixtures drilled, bolted and welded to the truck chassis by mechanics specially licensed for that work. To avoid such expense and complexity, we propose shallow bolt-on mounts. Most homeowners can install them with simple wrenches. FIG. 6 shows an add-on mounting assembly or adapter 126, fitting many Ford Motor Company cars, including their popular TAURUS (Reg. TM) brand models.

A chassis frame horn or frame rail end 121 offers a frame hole 123 and a frame opening or slot 125. Standard machine bolts, nuts and lock washers (not shown) can mount adapter 126 as follows:

The forward end of a mounting plate 128 is secured to frame rail end 121 by a bolt passed through an upper mount hole 134 into slot 125. That bolt is secured by large washers and a nut positioned inside the box structure of frame rail end 121. The opposite end of mounting plate 128 is secured by a second bolt passed through a lower mount hole 132 and then frame rail hole 123. This bolt is likewise secured by washers and a nut inside the box structure.

Typical heavy plow mounting fixtures reduce a motor vehicle's road clearance by 15 to 25 cm. But my mount adds only the thickness of mounting plate 128 plus a standard bolt head, totaling about one centimeter. A tie-down ear, anchor point or attachment post 130 is welded to mounting plate 128. It presents an anchor or plow-mounting hole 136 for attachment of arm 33 as shown in FIG. 3A.

SNOW THROWER EMBODIMENT—DESCRIPTION AND OPERATION

In driveway and parking areas narrowly defined by walls or close landscaping, homeowners may wish to throw snow well beyond. My plowing method does it with a major alteration of an otherwise conventional snow thrower. Its engine was formerly busy driving wheels at various forward and reverse speeds through a transmission. Now we remove the transmission and drive train, concentrating all the engine's power on the simpler remaining tasks: collecting the snow, and throwing it.

Figure 7:
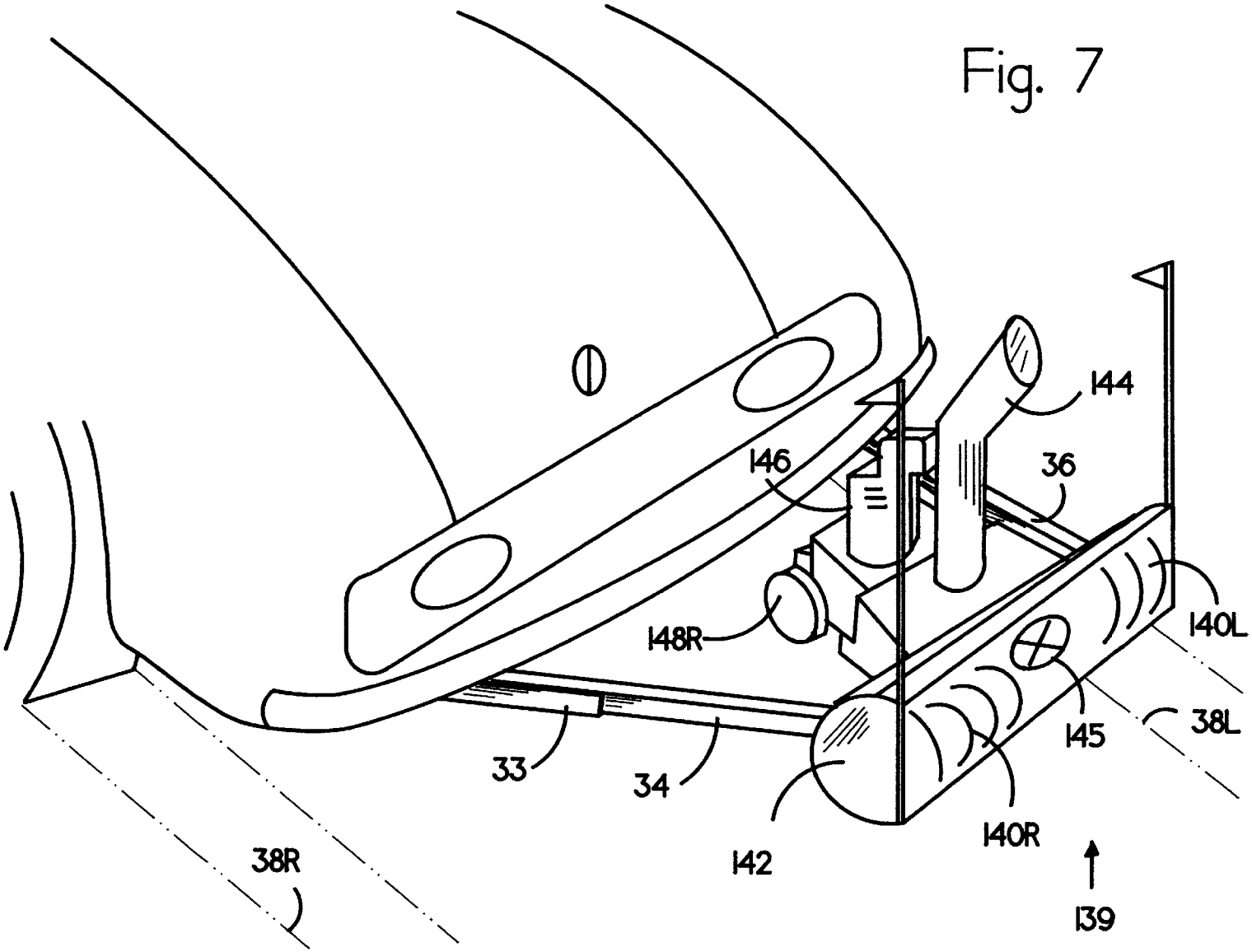
FIG. 7 shows a perspective view of a snow-thrower embodiment supporting my plowing method.

FIG. 7 shows one such embodiment, using an advanced version of the two-stage design well established in the art. Stage one is an assembly 139 of a pair of auger, screw or helical snow breaker halves 140R and 140L, of opposite hands or twists. These turn inside an auger housing, snow scoop or pickup box 142. The auger halves break up the snow and carry it from both ends toward the center of the housing. Both auger halves reach near, but not in front of, an impeller intake opening 145. This permits a wide band of snow to enter straight into the impeller, advancing by the car's power, without the auger interference caused in many earlier designs. In stage two, an impeller (not shown) picks up the snow and throws it up and out through a discharge chute or adjustable delivery pipe 144. Both stages, auger and impeller, are powered by an engine 146. Most of the thrower's weight is carried on a pair of wheels 148R and 148L (symmetrically opposite but not shown here).

The thrower may be attached to the motor vehicle by any of the alternative positioning devices described here for other embodiments. FIG. 7 shows a mounting arrangement similar to that detailed for our preferred embodiment in FIG. 3, using the car's tie-down anchor points.

DUAL TRAILER HITCH MOUNT DESCRIPTION

Figure 8:
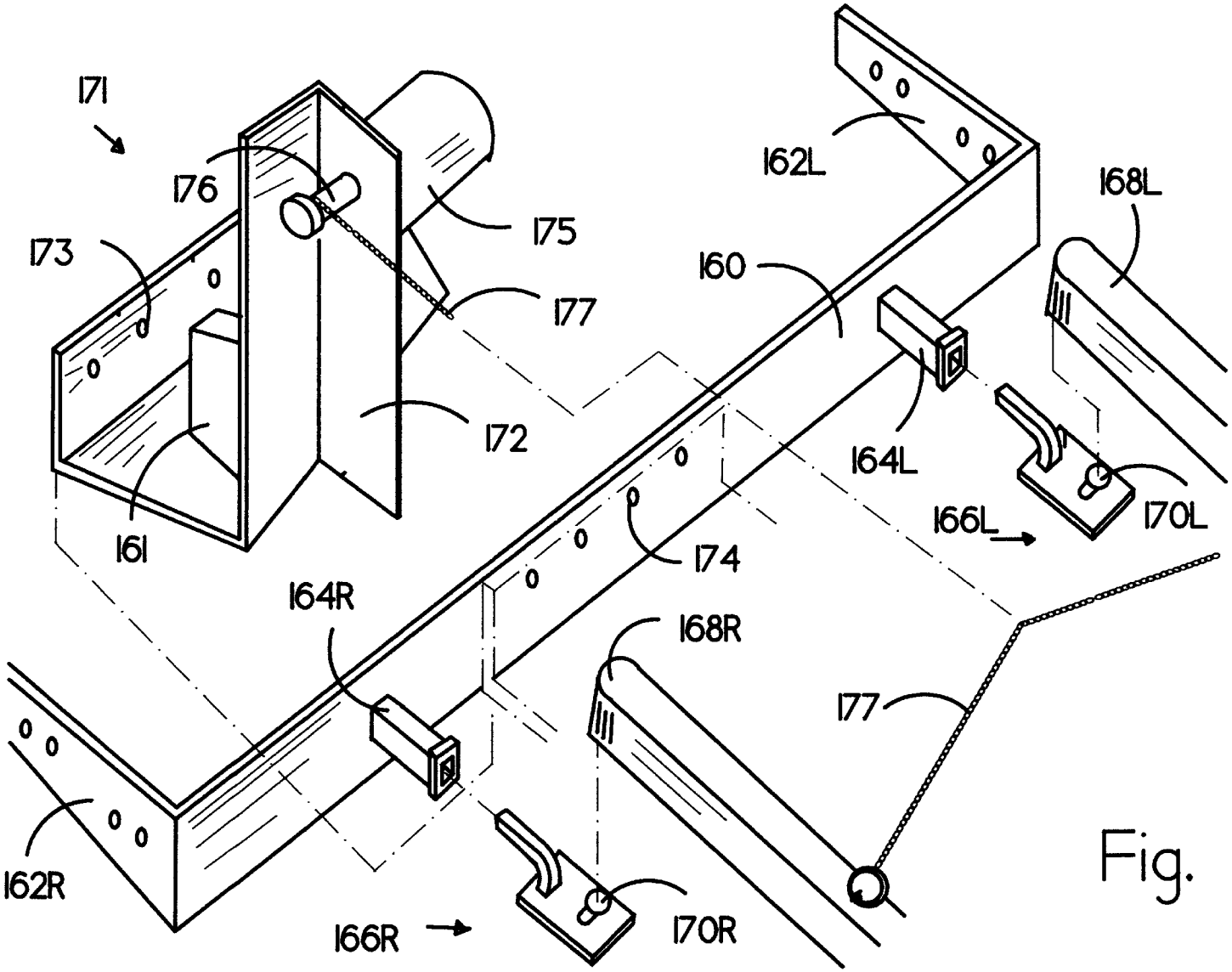
FIG. 8 shows an exploded view of a dual trailer hitch mounting embodiment with accessory electric winch.

FIG. 8 shows a dual trailer hitch alternative mount supporting various embodiments of my plowing method and their hardware.

A main beam or drawbar 160 is bolted to the vehicle's front frame members through a plurality of holes in a pair of mounting wings, anchors or frame mounts 162R and 162L. A pair of receivers or hitch sockets 164 R and 164L are attached to drawbar 160. Their openings are positioned flush with or slightly inside the face of the vehicle's bumper. A pair of detachable universal ball or hitch ball assemblies 166R and 166L fit into the sockets, secured by the usual locking pins (not shown).

A pair of mounting arms, thrust bars or attaching beams 168R and 168L terminate in standard female sockets well known in the art. Their adjustable snap locks secure the arms to a pair of hitch balls 170R and 170L.

To mount an optional accessory, an electric winch assembly 171, a plurality of holes 173 in a mounting plate 172 is aligned with a plurality of matching holes 174 on the drawbar and bolted (bolts not shown). A winch chain 177 is then connected to a winch drum 176 and to mounting arms 168R and 168L. A winch motor 175 plugs into the vehicle's electrical system. Switch controls (not shown) are furnished for the driver.

DUAL TRAILER HITCH MOUNT OPERATION

This mounting embodiment for snow removal devices supporting our method provides a base for mounting a removable electric winch. A winch can lift a moldboard plow 20 to 30 cm above the ground, for transport to other locations, and for back-plowing.

Electric winch assembly 171 operates by driver-controlled switch (not shown). Motor 175 winds chain 177 on drum 176, raising the plow. This repositioning makes plowing somewhat easier in corners. There, lowering the blade behind a snow pile and dragging the snow is easier than pushing it.

We remove ball assemblies and winch when not plowing snow. Thus we avoid the antisocial aspect of most winch mounts on pickup trucks and other vehicles. They often permanently carry jagged steel plate and hydraulic cylinder assemblies ahead of their bumpers. Those assemblies amount to battering rams needlessly threatening pedestrians and motorists all year long.

LADDER-FRAME MOUNT DESCRIPTION

Figure 9:
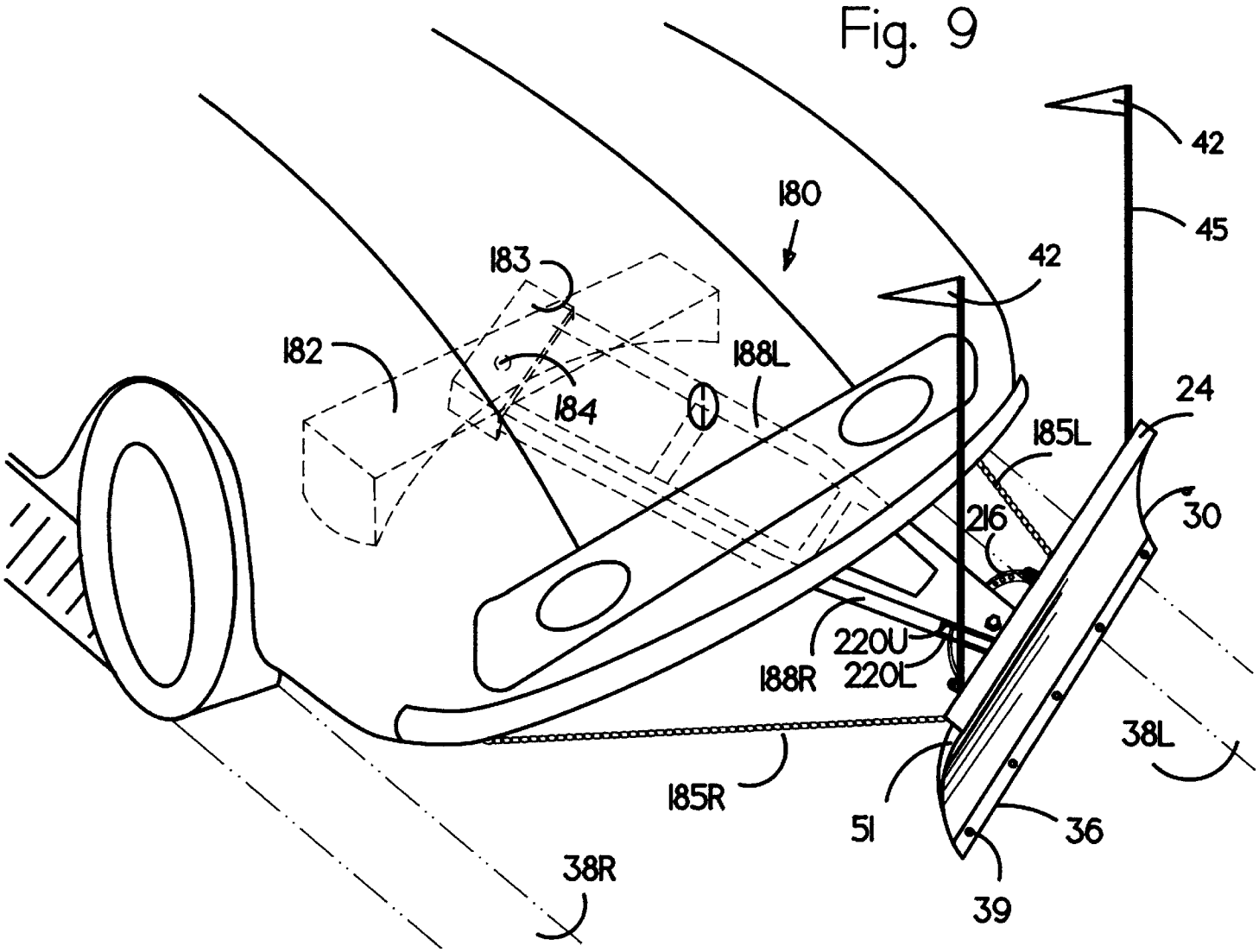
FIG. 9 shows a perspective view of a ladder-frame embodiment of my method mounted to a car frame center-point.

FIG. 9 shows another alternate mount for devices embodying my snow-removal method. A ladder frame, dual-arm carrier or double-rail mounting assembly 180 is attached at its forward end to moldboard 30. The rear end is attached beneath the motor vehicle at a single center hole 184 in a transverse frame member, engine support bed or vehicle crossbeam 182. The ladder frame is secured in place by a mounting fixture, bracket or box 183 at hole 184 by a single heavy anchor bolt, nut and lock washers (not shown). A pair of lateral chains 185R and 185L link the moldboard to convenient attachment points beneath the vehicle's front frame or bumper (not shown). A pair of ladder frame arms, rails or beams 188R and 188L merge at the forward end of ladder frame assembly 180, in an upper merge plate 220U and a lower merge plate 220L. The latter are more clearly seen in FIG. 9B.

Figure 9A:
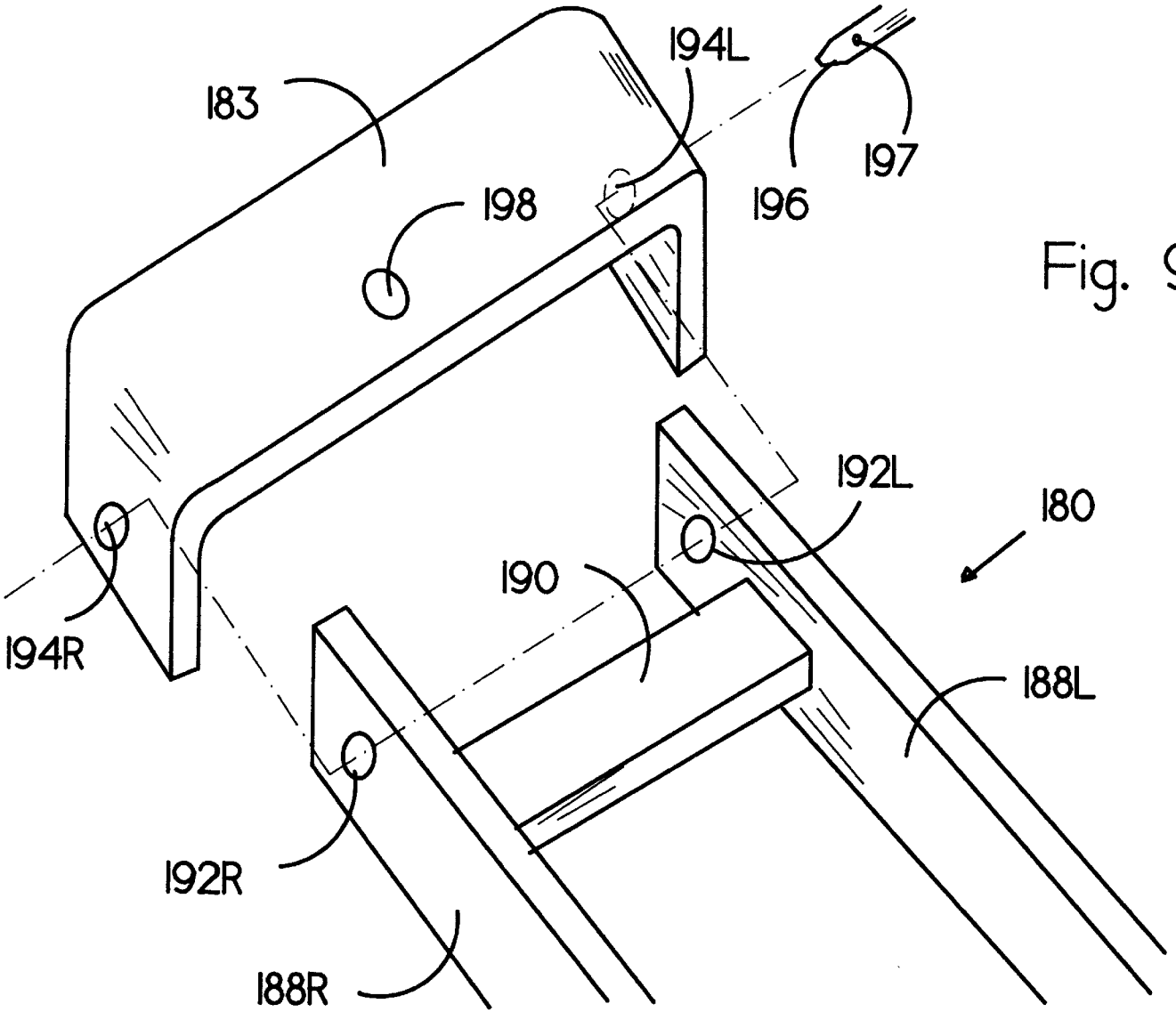
FIG. 9A shows an exploded closeup view of the ladder frame mounting bracket under the vehicle.

FIG. 9A shows how ladder frame assembly 180 is connected beneath the vehicle to bracket 183. Ladder frame arms 188R and 188L are locked together by a connector, ladder brace or cross rail 190. A pair of ladder arm holes 192R and 192L are aligned with a matching pair of bracket holes 194R and 194L. A locking bar, hinge pivot or connecting rod 196 is then inserted, and locked with hitch pins 89 through bracket locking holes 197, as shown in preceding embodiments. A bracket hole 198 is matched with center frame hole 184 and secured with a bolt, nut and washers (not shown).

Figure 9B:
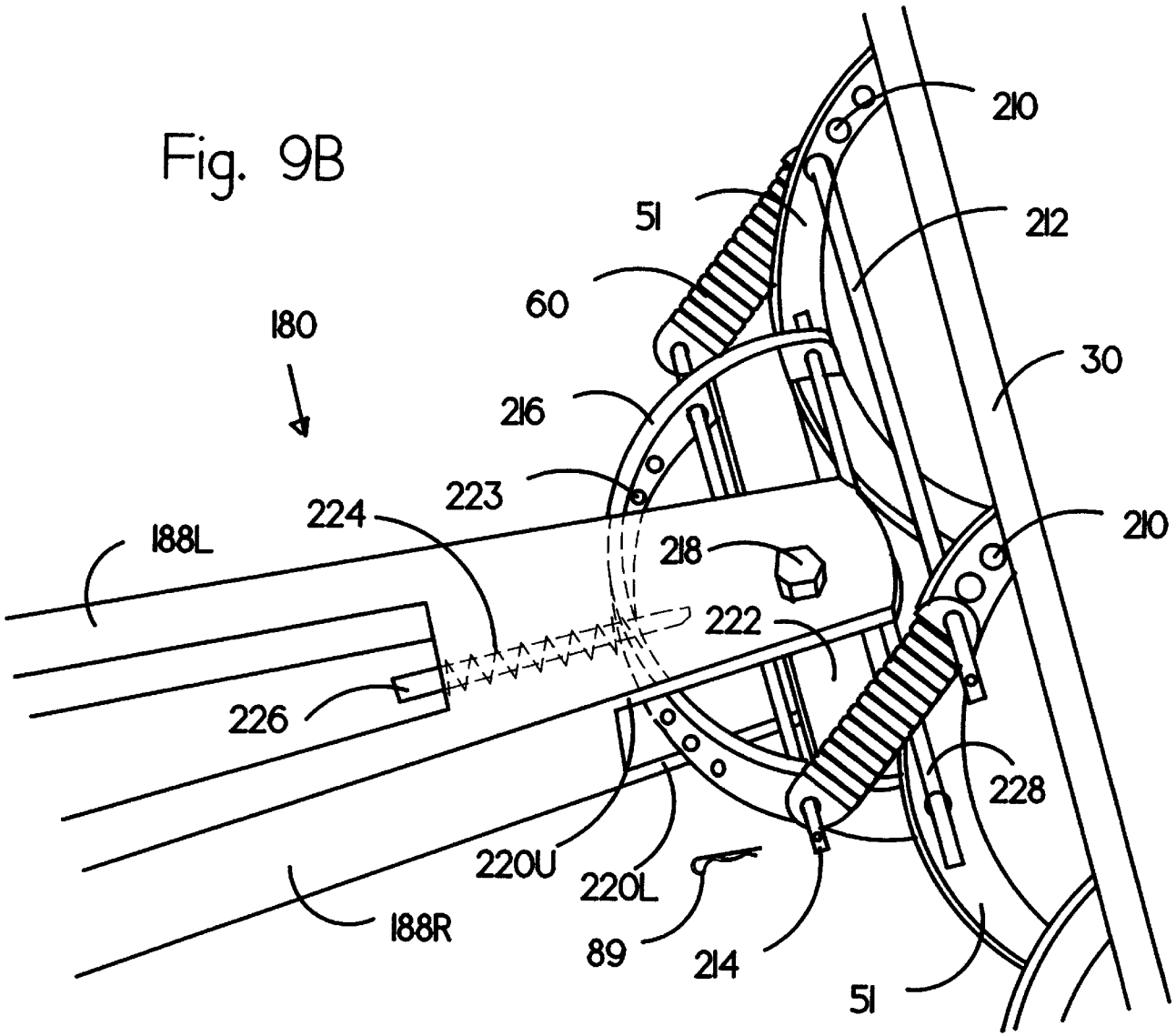
FIG. 9B shows a perspective view of adjusting devices and mounting of moldboard on ladder frame assembly.

FIG. 9B shows adjusting devices at the forward end of ladder frame assembly 180. Moldboard ribs 51 each have a plurality of vertical pitch adjusting holes 210. A pitch adjusting rod, hinge pin or axle 212 is inserted through tops of safety springs 60 and a pair of rib pitch adjusting holes 210 and secured with hitch pins 89. A bottom locking rod, spring hinge pin or pivot 214 is inserted through bottoms of safety springs 60 and a lateral adjusting ring or radial adjuster 216. A kingpin, center bolt or main pivot 218 pins adjusting ring 216 to ladder frame end piece, terminal or forward upper and lower merge plates 220U and 220L through a hole in the center of a ring crossbeam or lateral crossbar 222. Radial adjuster 216 has a plurality of angle adjusting holes or angle selectors 223. A pin spring 224 drives a selector pin, rod or shaft 226 through one of the angle selector holes 223, thereby locking the moldboard at a chosen angle to ladder frame arms 188. Finally, a lower hinge, rod or shaft 228 links moldboard 30 to radial adjuster 216 by passing through lower holes in moldboard ribs 51. Lower hinge 228 is then secured in place by hitch pins 89 at each end.

LADDER-FRAME MOUNT OPERATION

Two separate forces can cause the front end of ladder frame assembly 180 to rise up 20 to 30 cm. During plowing, snow pressure against the moldboard rises variously according to vehicle speed, blade angle and snow character (depth, density, temperature, etc.) When snow pressure reaches a predetermined point, it tilts the moldboard forward around its lower hinge 228. The upward component of snow pressure then moves the board and the front end of its ladder frame assembly upward. This is exactly the same unexpected but useful action described earlier in discussion of our preferred embodiment. It helps in pushing snow up to the tops of snow piles.

The other force raising the ladder frame is pull by the winch, when provided. Hinge pivot 196 allows the necessary movement. Lateral movement of the ladder frame is restrained by light lateral chains 185R and 185L.

Safety springs 60 operate here as in the preferred embodiment. Their upper mounting points may be selected in the same manner, to alter the moldboard's angle with the ground from vertical to forward tilt to back tilt. Further accommodation to snow conditions and driver preferences is available through radial adjuster 216. This is set by retracting selector pin 226 against its spring 224. The radial adjuster is then positioned right, left or center and the pin released to lock in one of the angle selection holes 223.

MINI-MOLDBOARD DESCRIPTION AND OPERATION

Figure 10:
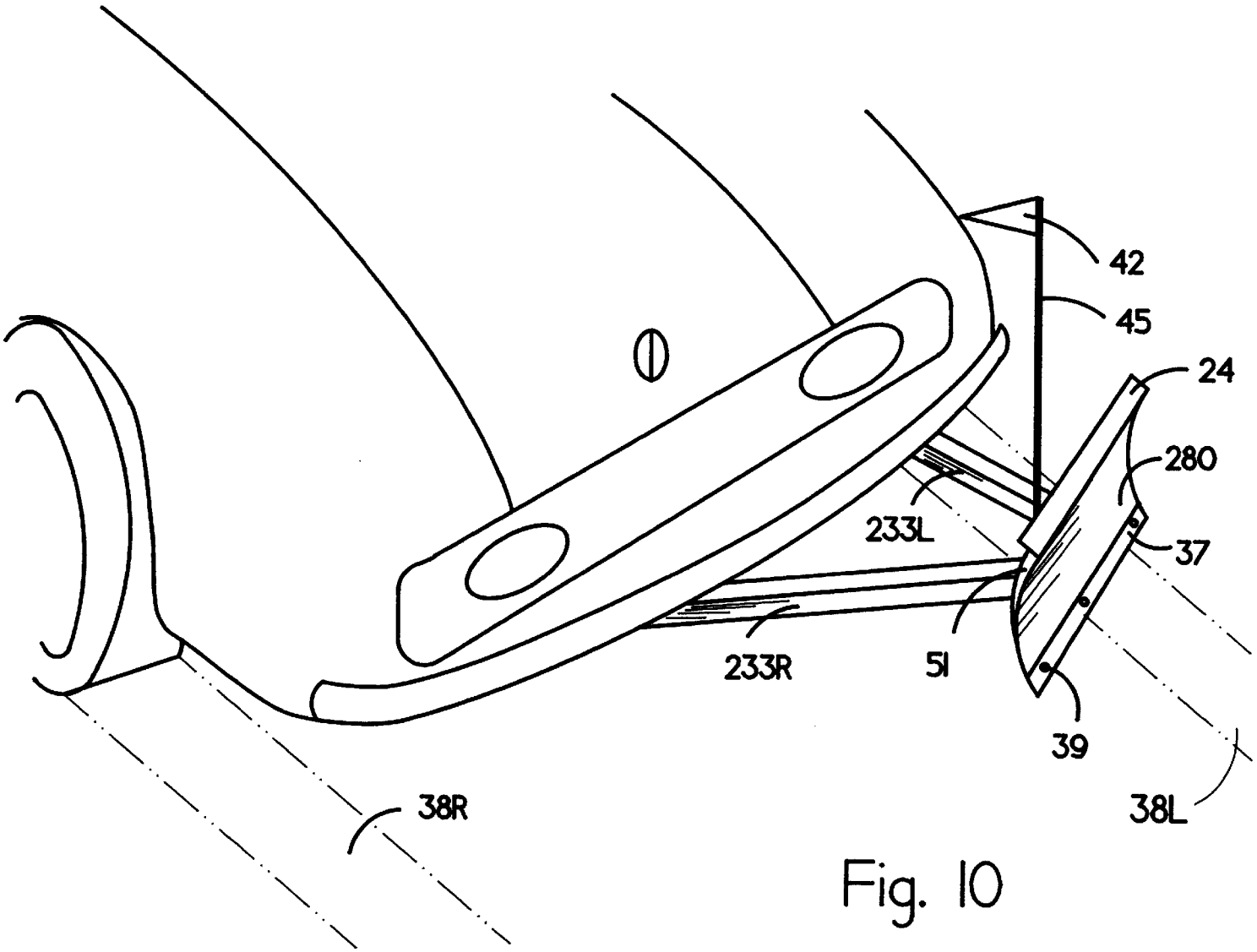
FIG. 10 shows a perspective view of a mini-moldboard plow embodiment mounted on a car.

FIG. 10 shows a mini-moldboard 280, approximately half the width of our preferred embodiment. It economizes with a pair of lighter mounting arms 233R and 233L, because working stresses will be lower. Elimination of one marker flag 42 and flagpole 45 is another economy. Otherwise this minimum-price model is assembled and operated much like the preferred embodiment. It is more convenient to store, inviting packing in the car's trunk for use away from home.

OFF-ANGLE THROWER DESCRIPTION AND OPERATION

Every thrower I have encountered has squarely addressed the plowing path. That is, the leading edge of its snow intake box is presented at right angles to the plowing path, while box sides are parallel to the path. Thrower snow-intake setups are generally symmetrical with regard to the centerline of the plowing path. My contoured moldboard thrower combination (FIG. 12) begins to break this pattern by angling the snow intake flow off to the left at an obtuse angle to the plowing path. We can extend that idea by drawing on the art heritage of moldboard plows. They are usually presented at an off-angle (other than 90 degrees) to the plowing path.

Figure 17:
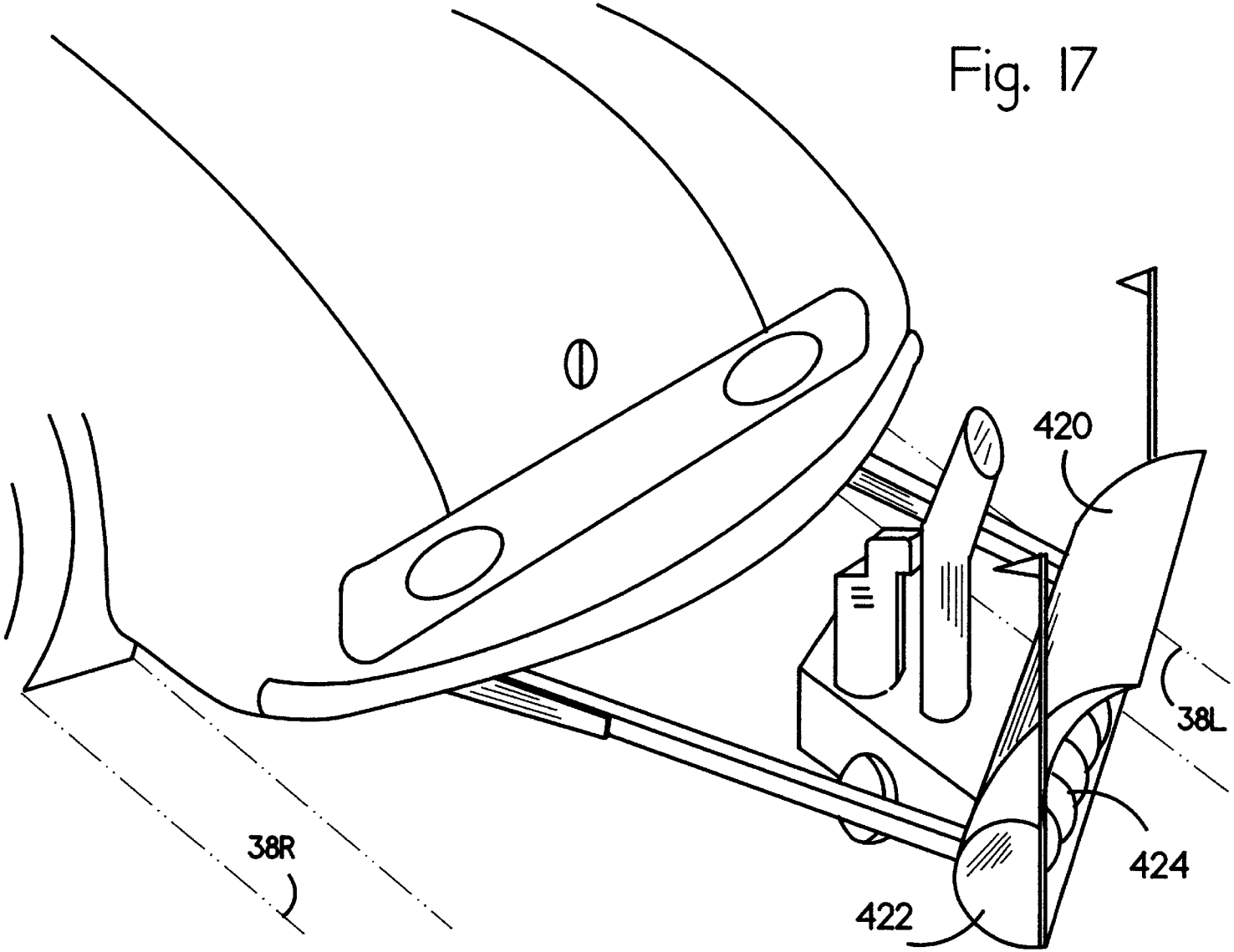
FIG. 17 shows a perspective view of an off-angle snow thrower.

An off-angle thrower is shown in FIG. 17. A snow intake box 422 and an auger 424 are both longer than the plowing path width, allowing a relatively wider than usual snow intake opening. Corresponding changes in auger and impeller design could handle more snow faster, or enable use of a smaller unit. An overflow moldboard 420 rising above the intake box provides a further advantage. The moldboard pushes some snow aside, rather than moving it all through the machine's innards as present throwers do.

VEE-PLOW DESCRIPTION AND OPERATION

Figure 11:
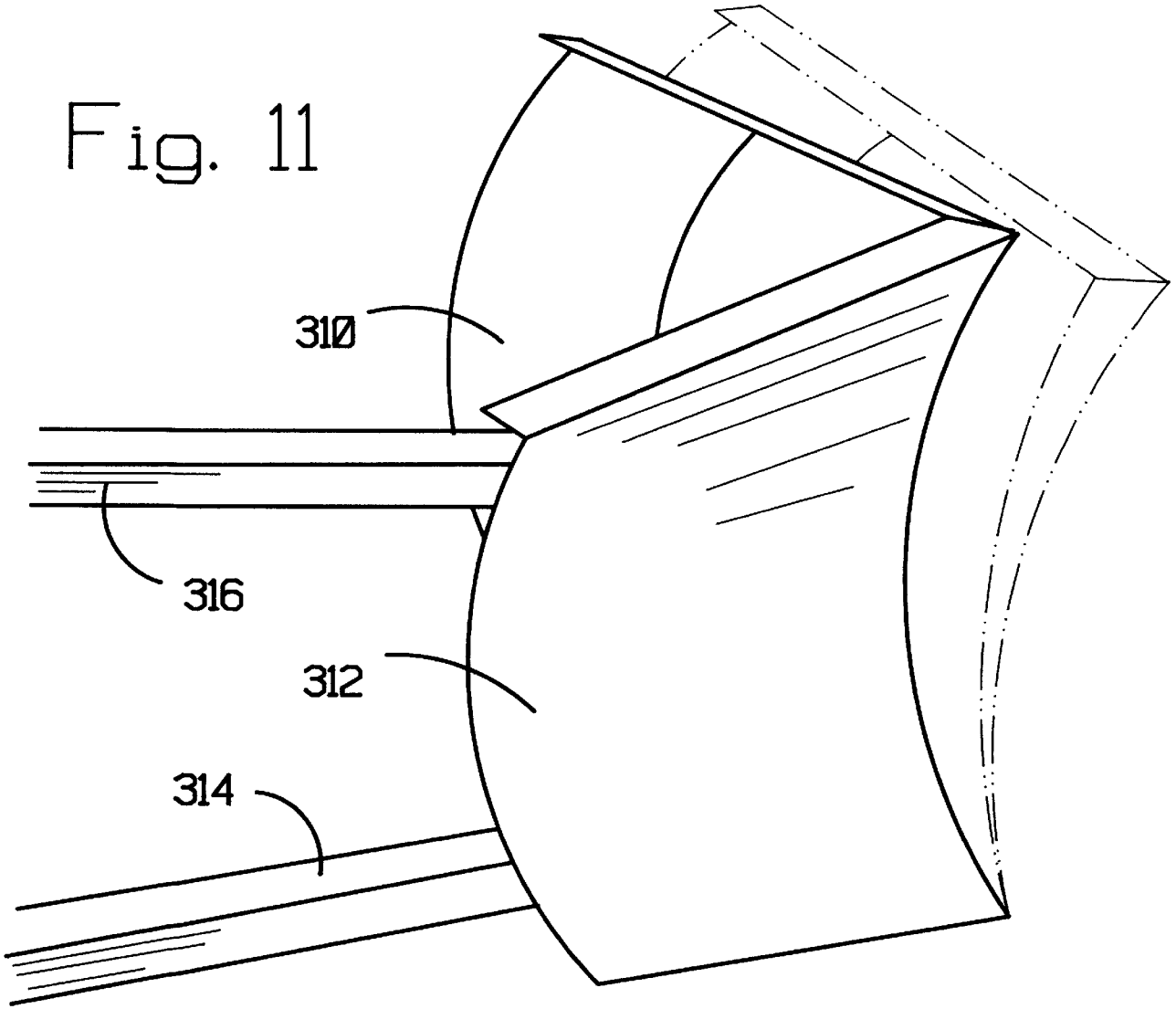
FIG. 11 shows a perspective view of a vee-wing plow embodiment.

FIG. 11 shows a vee-plow embodiment of my plowing method. Like our preferred embodiment, it is protected by springs (not shown here) set to trip the moldboard forward and flat to clear obstacles. A left moldboard 310 is shown as a phantom image as it begins to trip independently of a right moldboard 312. A pair of mounting shafts 314 and 316 is intended to mount at car tie-down anchor point ears like embodiments discussed earlier.

Vee-plow configurations have established themselves over many years as important in some plowing situations. A center-hinged variant of this embodiment of my plowing method might be especially useful in unusually deep snow. The center-hinged moldboard reverses from back-extending vee to forward-extending vee.

CONTOURED MOLDBOARD DESCRIPTION AND OPERATION

Figure 12:
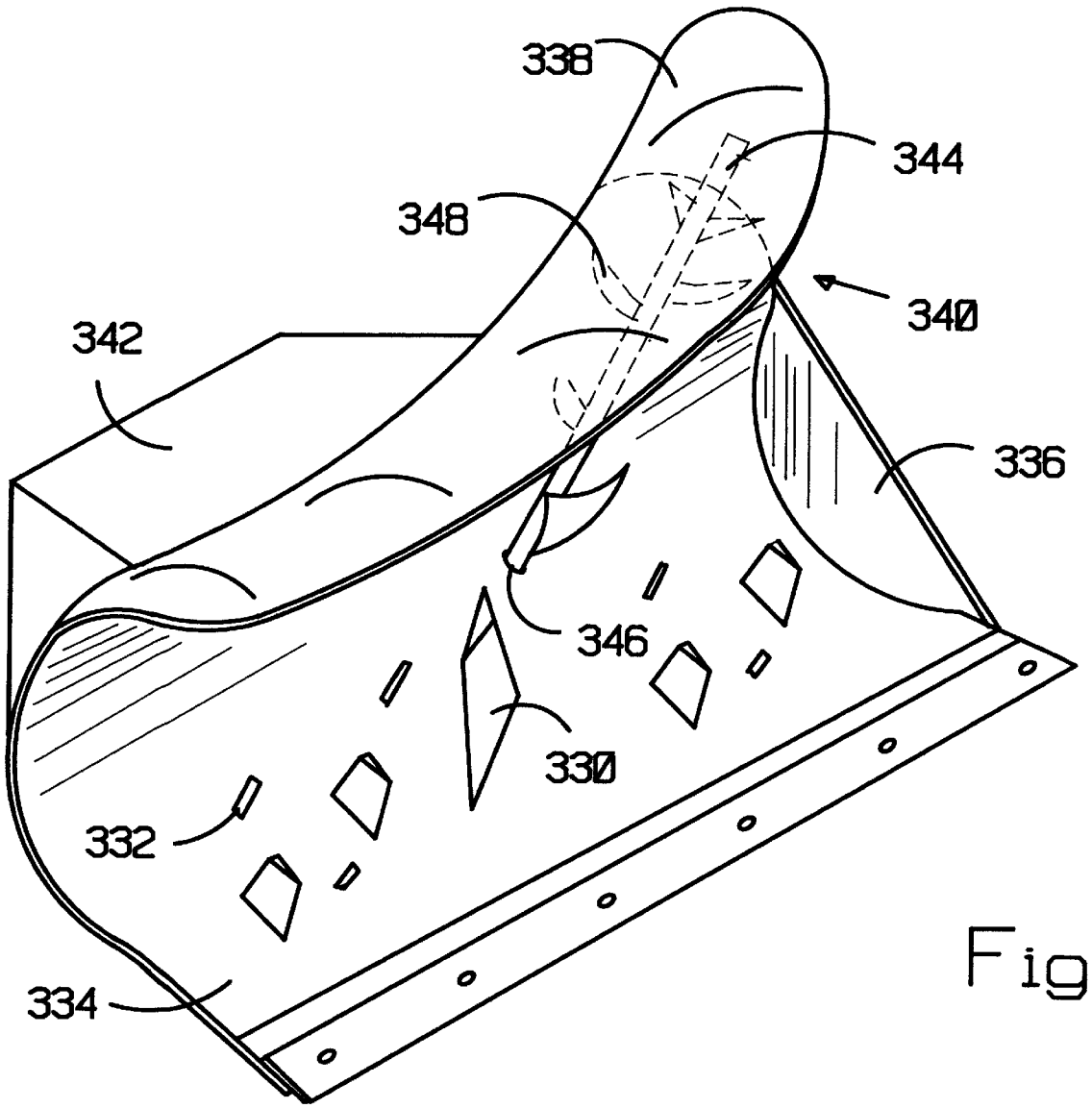
FIG. 12 shows a perspective view of a complex-contour moldboard with throwing rotor.

FIG. 12 shows a complex-contour moldboard combination with a power thrower. A plurality of teeth, ice-breakers, or guides 330 and a plurality of smaller teeth or pin breakers 332 is arrayed across the lower surfaces of a moldboard 334. The moldboard is angled to deliver broken-up snow from the teeth, fed from the car's forward motion, toward a moldboard left collector or wall 336 and a moldboard upper wing or curl 338. Collector 336 and curl 338 feed snow to a rotor assembly 340. An engine 342 (shown only as box) drives an impeller shaft 344, which passes through the moldboard at a hole 346. A plurality of blades 348 throws the snow clear of car and plowed path.

MULTI-STACK THROWER DESCRIPTION AND OPERATION

Figure 13:
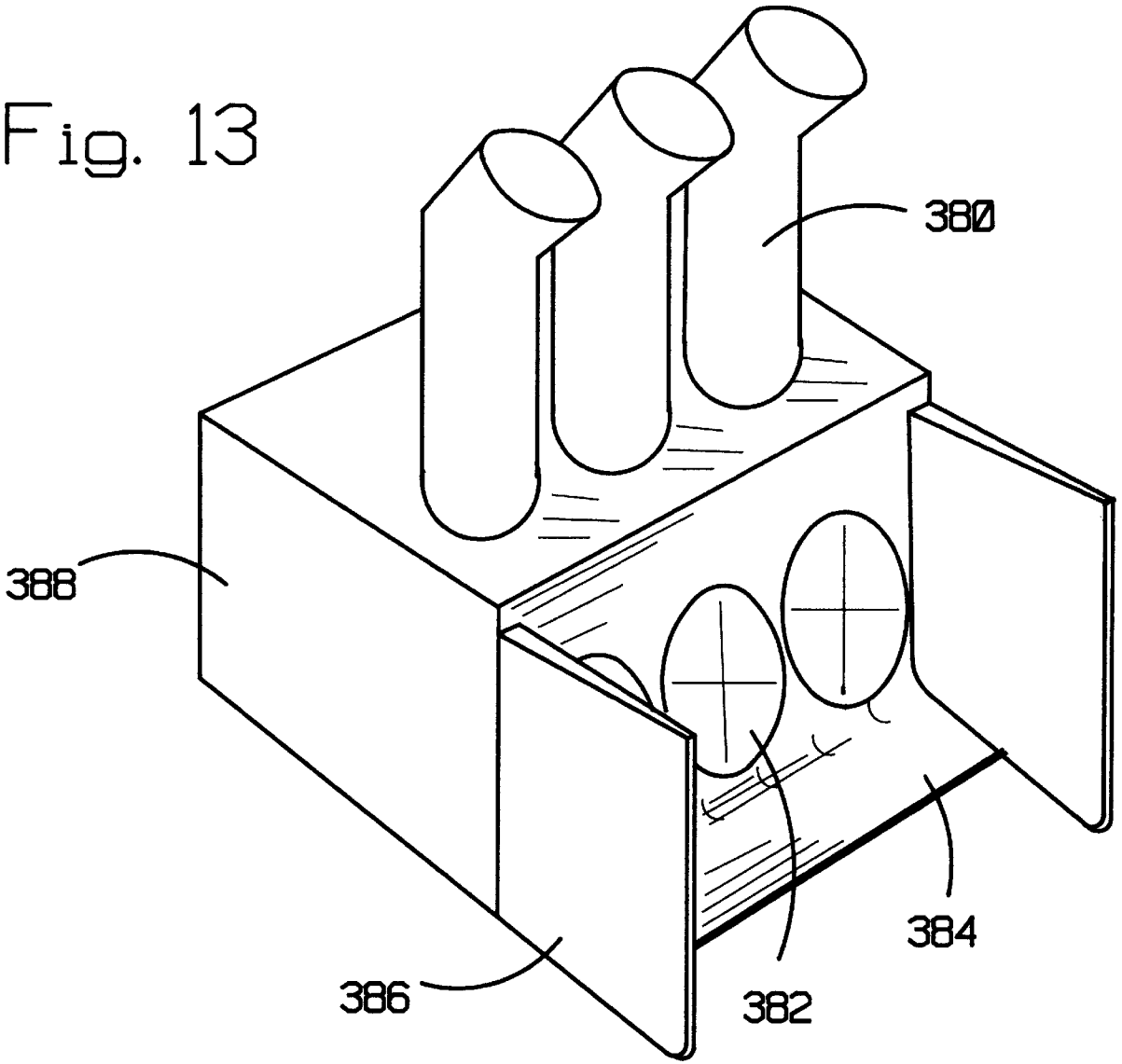
FIG. 13 shows a perspective view of a 3-stack direct-feed thrower.

FIG. 13 shows a snow thrower with a plurality of discharge chutes or parallel stacks 380. This design allows more precise placement of thrown snow than other throwers, because each stack is independently adjustable. Like the complex-contour moldboard, this embodiment is designed to take full advantage of the car's powerful forward motion for vigorous snow feeding. With no auger to produce transverse motion, snow feeds straight into each of a plurality of impeller intakes 382. A pickup blade or scraper 384 and a pair of side wings or snow guides 386 help direct snow into the impellers. The unit is powered by a prime mover 388, not shown except for general location.

ALTERNATE QUICK-CONNECTOR DESCRIPTION AND OPERATION

Figure 14:
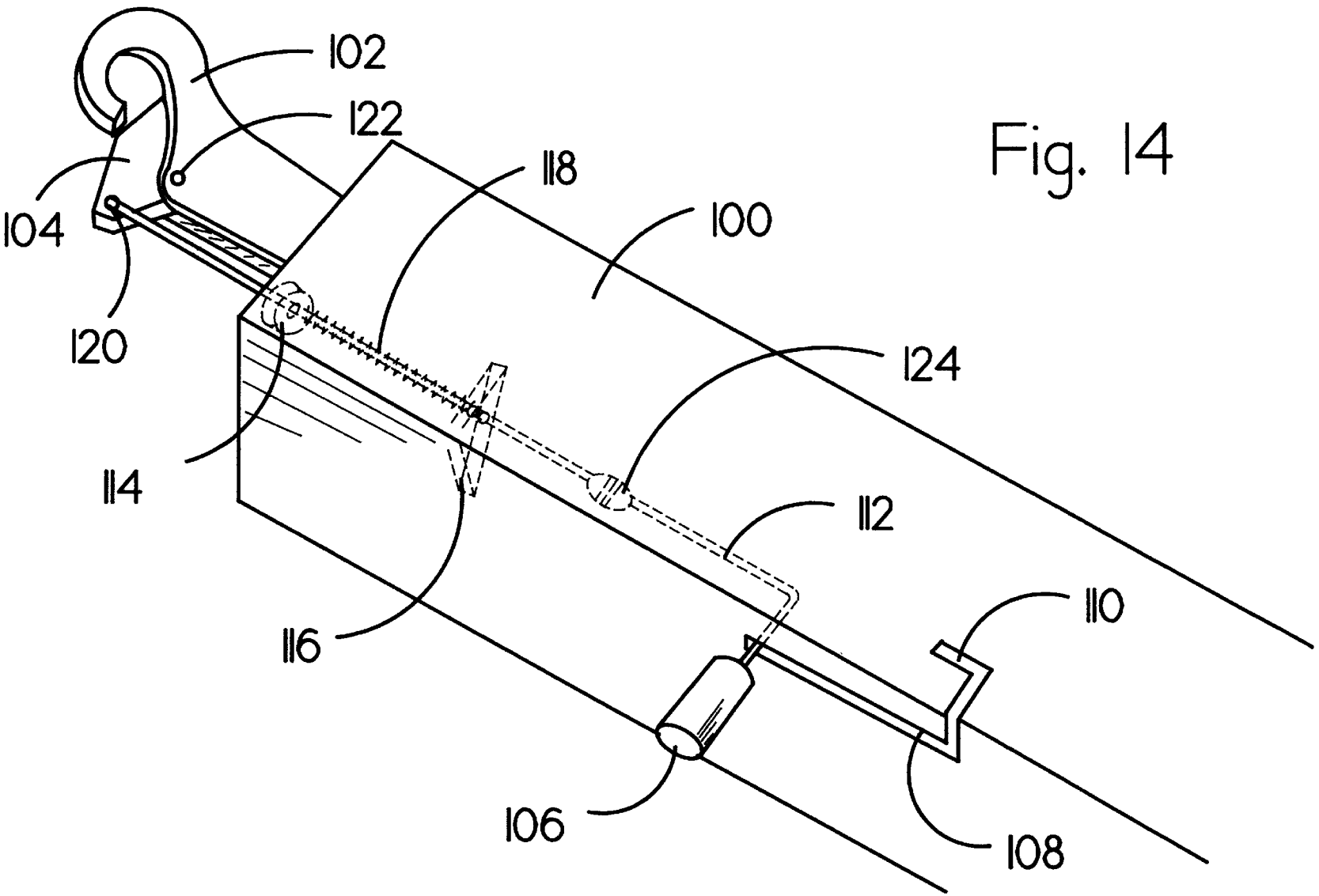
FIG. 14 shows a perspective view of a snap-lock quick-connector.

FIG. 14 shows an alternate embodiment of a quick-connecting device for mounting plow arms, such as those shown in our preferred embodiment. A hook arm 100 here terminates in a hook 102, which is intended to engage the hole in a motor vehicle's tie-down anchor point, such as that shown as chassis tie-down 72 in FIG. 3A. A hook snap latch or locking block 104 pivots at a latch hinge 122. A locking rod or operating shaft 112 begins at a handle 106. The shaft passes through a swivel connector 124, through a guide block or carrier plate 116, and links to latch 104 at a latch pivot hole 120. A latch spring 118 is retained between guide block 116 and a spring compressor 114 which is fixed on the upper portion of shaft 112 where the shaft exits through the top of arm 100.

The operator cocks the latch mechanism by pulling locking handle 106 to the outboard end of a main slot 108. Then she or he raises the handle and parks the handle end of shaft 12 in a locking slot 110. The latch remains open, under compression of spring 118. The operator then conveniently hooks the hole in the chassis tie-down ear with hook 102. When he releases the latch by returning handle 106 to its original position, the latch snaps shut and remains closed under residual compression from spring 118.

DEEP SNOW SCOOP DESCRIPTION AND OPERATION

Figure 15:
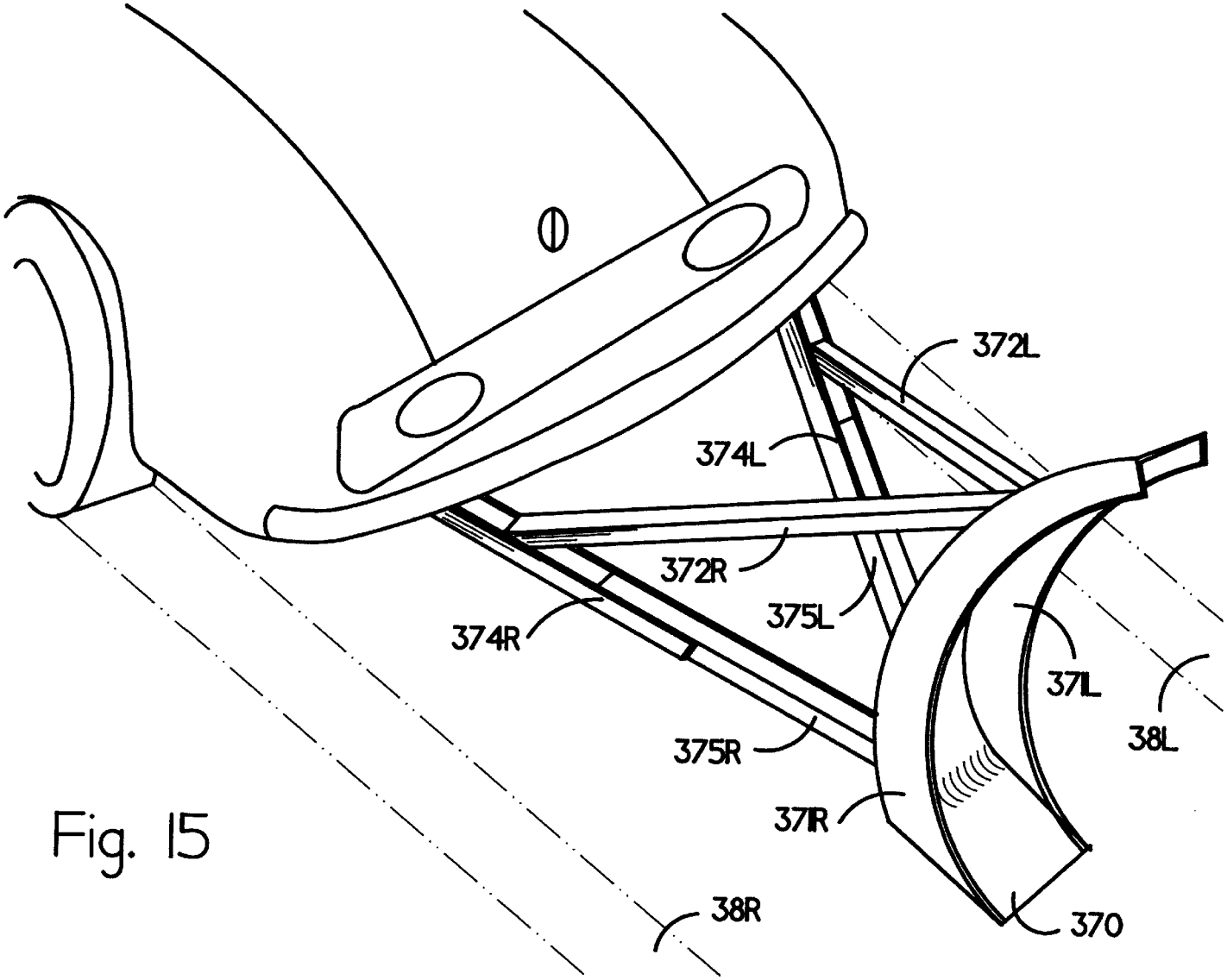
FIG. 15 shows a perspective view of a deep-snow tower plow.

FIG. 15 shows an embodiment of my snow removal method intended for the world's snowiest residential locations. Our uniquely high horsepower per square meter of moldboard area makes plowing easy under most conditions, with the various embodiments discussed above. However, facing possible overnight snow accumulations one to two meters in depth, our method meets its greatest challenge. So does the family car.

To minimize stresses on both car and plow, we propose sharp departures from previous embodiments, not only in plow design but also in plowing technique. Our previous embodiments have all had moldboard widths substantially greater than heights. In the case of snow throwers, we can equate snow acceptance areas with moldboard faces for comparison. For example, the snow thrower of FIG. 7 has a snow acceptance area roughly defined by the frontal dimensions of snow receiver box 142.

The deep snow plow of FIG. 15, however, reverses the proportions. A tall moldboard 370, together with a pair of sidewalls or discharge guides 371R and 371L, twists just enough leftward of the car's longitudinal center-line to throw snow well clear of projected left wheel track 38L. A pair of telescoping thrust arms or mounting rails connects the moldboard to the car's chassis tie-downs as in some previous embodiments. The thrust arms are set at equal length, centering the moldboard between the car's projected wheel tracks. This symmetrical mounting is intended to produce maximum stiffness when the plow is operating against maximum resistance, just short of tripping the obstacle release.

The arms are comprised of a pair of upper arms or outer cases 374R and 374L and a pair of lower arms or inner slides 375R and 375L. Spring-loaded mechanisms (not shown) inside the two arm assemblies are designed to release at a predetermined level of thrust pressure. That release protects moldboard 370 from damage when it strikes obstacles. The moldboard then swings back and up to clear the obstacles. A pair of braces or secondary thrust arms 372R and 372L connect the moldboard's upper end to upper arms 374R and 374L respectively. Both braces and lower arms are pivotally connected (not shown) to the moldboard at its rear, to facilitate release and obstacle-clearing.

The most common plowing pattern for our previous embodiments is suggested in FIG. 4. Most moves shown there are long, slow plowing passes, at low speed, with low engine power. A change of technique is needed for deep snow. The plow of FIG. 15 will require a somewhat more rapid approach to the unplowed depths, with more engine power. It will make shorter plowing passes, and more total passes to clear a given driveway size.

BLOCK PLOW DESCRIPTION AND OPERATION

Figure 16:
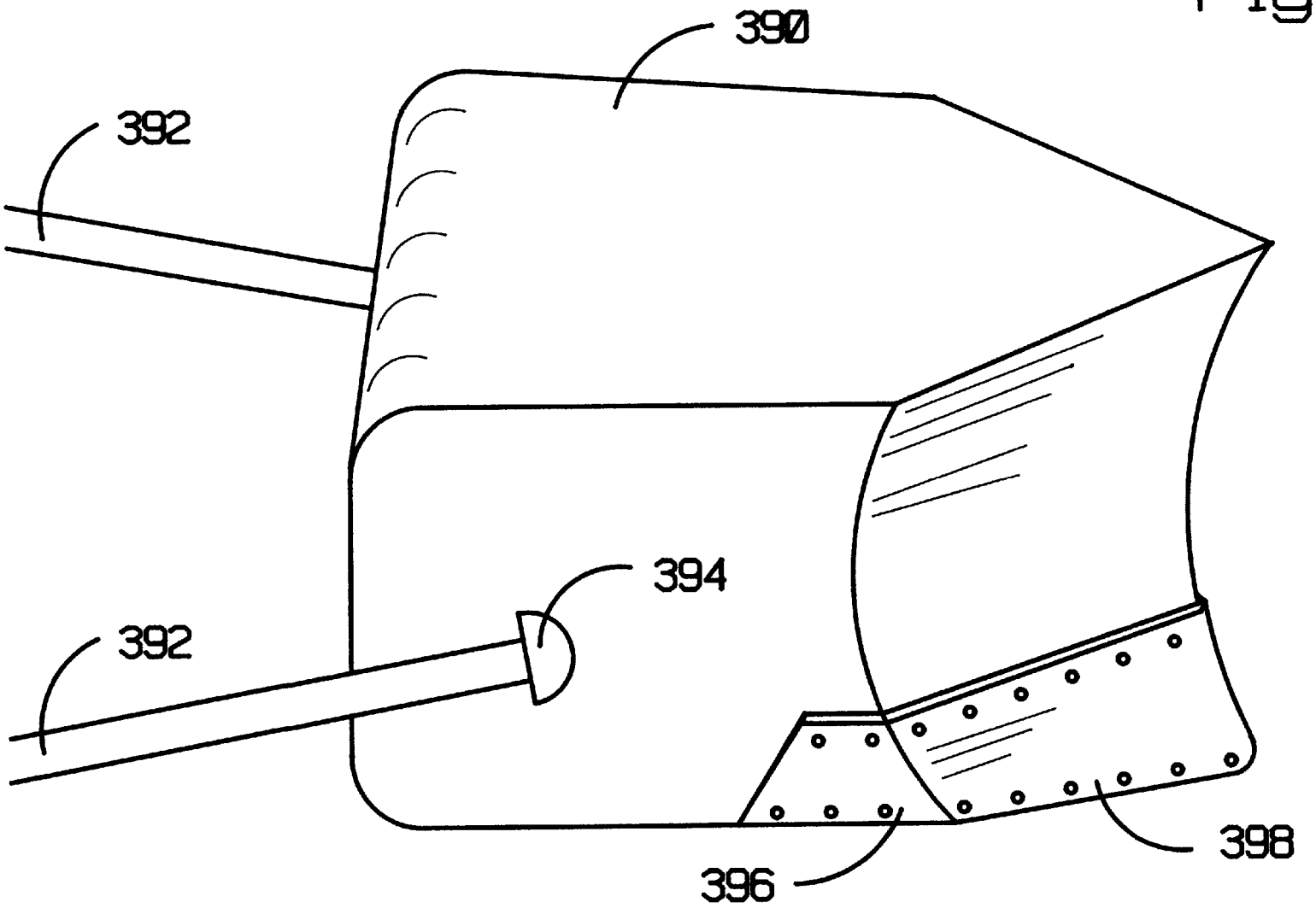
FIG. 16 shows a perspective view of a vee-block plow.

FIG. 16 shows a lightweight block vee-plow 390. It offers near-maximum simplicity of construction and installation, and probably near-maximum cost competitiveness. A pair of adjustable web belts 392 with tension adjusters (not shown) links the block from a pair of belt anchors 394 to the car's chassis tie-downs. A pair of steel side plates or armor shields 396 and a pair of front shields 398 protect the most vulnerable surfaces against impacts from ice blocks and broken pavement.

To achieve ultimate simplicity, we omit the belt anchors and convert this plow to a free-standing floater. That is, leave it unattached to the propelling vehicle. To complete it, we add to the rear vertical surface, the block face pushed by the vehicle, a combination of frictional engagement devices: clingy, rubbery, toothy surfaces that would establish temporary friction locks with front bumpers of propelling vehicles. Those friction locks would keep the plow positioned during one plowing pass. The driver would then have to back off, reposition the vehicle for a second pass, climb out of his vehicle to turn the floater around, then move his vehicle up to re-engage the floater for a second pass. Or perhaps he could turn the plow by rope from his car window. This arrangement would get the job done at minimum cost.

CONCLUSION, RAMIFICATIONS AND SCOPE

Shrink the commercial snowplow blade from its usual two-meter width to one meter. Shrink its usual 75-cm height to 37. Now you have created a tool that lets homeowners use a new method of clearing snow from home driveways. A hundred years of the art have taught that it could not be done. But the reader has seen us do it. Narrow-path, high-power-ratio plowing with the family car at last makes a hard job easy.

My high-power method will save the lives of some homeowners, who might otherwise be over-exerting with shovels while exposed to extreme weather. For all users of my method, life will be better because a burdensome chore is made easier and cheaper, using long-lasting and comparatively inexpensive tools. A fresh element of independence is injected into the lives of homeowners who may now control their own snow removal, without waiting for a plowman who may not come.

My method retains the best, time-proven features from prior-art devices. In addition, my method generates a family of new products:

a one-meter moldboard car plow, which may prove to be the most widely useful of these products;

a mini-moldboard, compact and economical;

a vertical moldboard for the deepest snows;

narrow-path, car-propelled snow throwers;

combination moldboard-throwers;

off-angle snow throwers.

Many variations are envisioned beyond those discussed above and shown in the drawings. For example:

A) Convertible moldboard: the one-meter preferred embodiment of FIG. 3 plus fittings to accept a pair of braces like 372R and 372L in FIG. 15. When the biggest storm comes, stand this moldboard on end, brace it, and plow with the short side on the ground. A bolt-on skid for that edge would be a cheap, useful addition.

B) Commercial version: more ruggedly built than our preferred model, perhaps in more expensive polyplastics rather than steel. This would serve postal, military, delivery-truck and other vehicle fleets. Their snow-plowing in small areas might be done more economically with my narrow-path method.

C) Space-age materials models for the folks who will spend to impress neighbors, or to buy extra-lightweight convenience: reinforced plastics with glass or graphite fibers, honeycomb structures, aircraft-metal alloys, high-intensity LED lights atop our guide flagpoles.

D) Disappearing truck version: vehicles having ample ground clearance could use hinge-and-swivel arms to store our preferred-embodiment moldboard in a horizontal position beneath the truck. So positioned, my moldboard reduces ground clearance by less than 9 cm. Throughout the winter, wherever the vehicle encountered a need, it could be swung out and locked for use.

E) Reversing-vee: a center-hinged vee plow which could be set in the usual seven alternate positions:

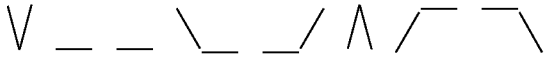

F) Drop-through moldboard: a large opening in the moldboard surface feeds the intake impeller for a combination thrower/moldboard.

G) A pair of mounting arms such as 35 and 36 in FIG. 3, sold as an accessory: converts the garden-tractor moldboard plow you already own into a car plow.

H) Bushings, sleeves or spacers for vehicle tie-down anchor-point ears: the hole in these ears is unusually large in some vehicles. Bushings inserted in those holes will tighten the connection to arm fittings of snow removal devices.

I) Narrow snow throwers carrying electric motors, rather than gasoline engines, for smooth, quiet throwing operation. Dragging a cable from a garage outlet would be one way to power these units. Special emphasis on slow, safe, planned plowing passes would be required.

J) Narrow-width conventional-design single-stage snow thrower: impeller extends full width of snow intake box, as opposed to multi-stage throwers and combination throwers shown in our drawings.

K) Rear-of-car trailer hitch mounting snow removal devices, for those who really prefer to plow backwards. Rear-mounted devices might also include forward-plowing snow removers being pulled rather than pushed.

L) Various features usable on several narrow-path plow types: bolt-on blade-widening side extensions; wheels or casters for smoother plow movement; square moldboard as compromise between mini and preferred shapes; plow arms mounted to free-wheeling hubs on the motor vehicle's front wheels, providing precision plow steering for unusual landscape situations requiring it; safety-release springs arranged to use spring compression rather than the tension of our springs 60 of FIG. 3B; blade lifters which swing into action to reduce function when backing.

M) Neat painting is needed not only to protect steel plows from corrosion but also to take advantage of the moldboard face as natural billboard. It makes a fine display area for an evocative trademark.

Although the descriptions offered above contain many specificities, this should be clearly understood: our meager array of drawings and suggestions is not aimed at restricting the wide field opened by narrow-path plowing. Our examples should be seen as mere illustrations of a few embodiments of this invention. Many other variations are possible beyond those presented here.

Thus the scope of my invention should be determined by the appended claims and their legal equivalents, rather than by the examples offered.

I claim:

1. A method of removing snow with a motor vehicle, comprising the steps of:

A. providing a snow removal means sufficiently narrow to leave at least one of said motor vehicle's wheel tracks unplowed, B. providing said snow removal means sufficiently wide to clear a swath of a minimum width of about half the distance separating left and right wheels of said motor vehicle, C. positioning said snow removal means for temporary propulsion by said motor vehicle, D. guiding and advancing said motor vehicle and said snow removal means onto a snow-covered surface, and E. snow plowing.

2. The method of claim 1 wherein said step of positioning is accomplished by using a quick-connecting means for connection to motor vehicle's said chassis tie-down ears.

3. The method of claim 1 wherein said step of positioning includes providing and installing a pair of add-on chassis tie-down ear components to said motor vehicle requiring such components, and using a quick connecting means to connect said snow removal means to said add-on components.

4. The method of claim 1 wherein the step of snow plowing uses a snow thrower.

5. The method of claim 1 wherein the step of snow plowing uses a moldboard plow.

6. The method of claim 1 wherein the step of snow plowing uses a narrow, vertical-moldboard deep-snow plow.

7. The method of claim 1 wherein the step of snow plowing uses a combination moldboard and snow-thrower.

8. The method of claim 1 wherein the step of snow plowing uses a vee-shaped moldboard plow.

9. The method of claim 1 wherein the step of snow plowing uses an off-angle thrower.

10. A snow removal device for use with a motor vehicle, comprising:

A. a snow removal means sufficiently narrow to leave at least one of said motor vehicle's wheel tracks inplowed, and B. said snow removal means sufficiently wide to clear a swath of a minimum width of about half the distance separating left and right wheels of said motor vehicle, and C. two arms for attaching said snow removal means to said motor vehicle for temporary propulsion by said motor vehicle, D. means located on said snow removal means near distal ends of said arms for attachment to said motor vehicle, said arms extending at sufficient angles to allow opposite ends of said arms to be secured temporarily to tie down chassis ears located near chassis corners of said motor vehicle.

11. The snow removal device of claim 10 further including a quick-connecting means adapted to connect said snow removal means to said chassis tie-down ears of said motor vehicle.

12. The snow removal device of claim 10 further including a pair of add-on chassis tie-down ears components for installation on said motor vehicle, said add-on chassis tie-down ear components adapted to connect said snow removal device to said motor vehicle.

13. The snow removal device of claim 10 wherein said snow removal means is a snow thrower.

14. The snow removal device of claim 10 wherein said snow removal means is a moldboard plow.

15. The snow removal device of claim 10 wherein said snow removal means is a narrow, vertical-moldboard deep-snow plow.

16. The snow removal device of claim 10 wherein said snow removal means is a combination moldboard and snow-thrower.

17. The snow removal device of claim 10 wherein said snow removal means is an off-angle thrower.

18. The snow removal device of claim 10 wherein said snow removal means is a vee-shaped plow.

19. A method of adapting and using a lawn tractor snow removal means for snow removal by a motor vehicle comprising the steps of:

A. selecting said lawn tractor snow removal means sufficiently narrow to leave at least one of said motor vehicle's wheel tracks unplowed and sufficiently wide to clear a swath of a minimum width of about half the distance separating left and right wheels of said motor vehicle, B. providing means for attaching said snow removal device to said motor vehicle for temporary propulsion by said motor vehicle, C. attaching said snow removal device to said motor vehicle, D. guiding and advancing said motor vehicle and said lawn tractor snow removal means onto a snow-covered surface, and E. snow plowing.

* * * * *

UNITED STATES PATENT AND TRADEMARK OFFICE

CERTIFICATE OF CORRECTION

PATENT NO. : 6,009,642
DATED : January 4, 2000
INVENTOR(S) : Gordon W. Nugent

It is certified that error appears in the above-identified patent and that said Letters Patent is hereby corrected as shown below:

Title page,
Item [57], ABSTRACT,
Line 22, change “annor” to -- armor --.

Column 9,
Line 42, change “tip” to -- up --.

Column 12,
Line 51, change “maximtum” to -- maximum --.

Column 17,
Line 28, change “12” to -- 112 --.

Column 20,
Line 11, change “function” to -- friction --.
Line 44, change “motor vehicle’s said” to -- said motor vehicle’s --.
Line 67, change “inplowed” to -- unplowed --.

Signed and Sealed this

Tenth Day of December, 2002

JAMES E. ROGAN
*Director of the United States Patent and Trademark Office*